US006325482B1

(12) United States Patent
Hayasaki et al.

(10) Patent No.: US 6,325,482 B1
(45) Date of Patent: Dec. 4, 2001

(54) METHOD AND APPARATUS FOR CORRECTING PRINTHEAD, PRINTHEAD CORRECTED BY THIS APPARATUS, AND PRINTING APPARATUS USING THIS PRINTHEAD

(75) Inventors: Kimiyuki Hayasaki; Koji Yamakawa; Yutaka Koizumi, all of Yokohama; Tsuyoshi Orikasa, Musashimurayama; Hiroyuki Kigami, Ebina; Hisashi Fukai, Yokohama; Takayuki Ono; Masayoshi Ohkawa, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,489

(22) Filed: Sep. 8, 1999

(30) Foreign Application Priority Data

Sep. 10, 1998 (JP) ..... 10-257178

(51) Int. Cl.[7] ..... B41J 29/393
(52) U.S. Cl. ..... 347/19
(58) Field of Search ..... 347/13, 14, 15, 347/19

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 5,016,023 | 5/1991 | Chan et al. | 347/42 |
| 6,145,951 * | 11/2000 | Hayasaki et al. | 347/19 |

FOREIGN PATENT DOCUMENTS

| | | |
|---|---|---|
| 54-56847 | 5/1979 | (JP) . |
| 55-132253 | 10/1980 | (JP) . |
| 59-123670 | 7/1984 | (JP) . |
| 59-138461 | 8/1984 | (JP) . |
| 60-71260 | 4/1985 | (JP) . |
| 2-2009 | 1/1990 | (JP) . |
| 4-229278 | 8/1992 | (JP) . |
| 4-232749 | 8/1992 | (JP) . |
| 5-24192 | 2/1993 | (JP) . |
| 7-242004 | 9/1995 | (JP) . |

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

An apparatus and method for accurately and rapidly correcting a printing characteristic of a printhead, a printhead whose printing characteristic is corrected by the above apparatus, and a printing apparatus using the printhead. In the apparatus for correcting the printing characteristic of the printhead, n kinds of printing control signal patterns are used to a full line printhead, printing patterns are experimentally printed in response to the printing control signal patterns on a printing medium and a reference density distribution is generated from one of n kinds of the printing patterns printed. Then, one of the n kinds of printing control signal patterns is selected for each of a plurality of printing elements such that a density value on each pixel is equal or close to the reference density distribution. In this case, a similar selection is carried out on another reference density distribution generated on the basis of another one of the n kinds of printing patterns, and an optimum one of the n kinds of printing control signal patterns is determined as correction data.

18 Claims, 17 Drawing Sheets

METHOD AND APPARATUS FOR CORRECTING PRINTHEAD, PRINTHEAD CORRECTED BY THIS APPARATUS, AND PRINTING APPARATUS USING THIS PRINTHEAD

BACKGROUND OF THE INVENTION

This invention relates to a method and apparatus for correcting a printhead, a printhead corrected by this apparatus, and a printing apparatus using this printhead. More particularly, the invention relates to a method and apparatus for correcting, by way of example, a full-line printhead equipped with a plurality of printing elements corresponding to the printing width of a recording medium, a printhead corrected by this apparatus, and a printing apparatus using this printhead.

A printer or the printing section of a copying machine or facsimile machine is so adapted as to print an image, which comprises a dot pattern, on a recording medium such as a paper, a thin plastic sheet or fabric based upon image information.

Among these printing apparatus, those which are the focus of attention because of their low cost are mounted with printheads that rely upon the ink-jet method, the thermosensitive-transfer method or the LED method, etc., in which a plurality of printing elements corresponding to dots are arrayed on a base.

In a printhead in which these printing elements are arrayed to correspond to a certain printing width, the printing elements can be formed through a process similar to a semiconductor manufacturing process. Accordingly, a transition is now being made from a configuration in which the printhead and driving integrated circuitry are arranged separately of each other to an integrated assembled configuration in which the driving integrated circuitry is structurally integrated within the same base on which the printing elements are arrayed. As a result, complicated circuitry involved in driving the printhead can be avoided and the printing apparatus can be reduced in size and cost.

Among these types of printing methods, the ink-jet printing method is particularly advantageous. Specifically, according to this method, thermal energy is made to act upon ink and the ink is discharged by utilizing the pressure produced by thermal expansion. This method is advantageous in that the response to a printing signal is good and it is easy to group the orifices close together at a high density. This method attracts a great deal of attention in comparison with the other methods.

When the printhead is manufactured by applying a semiconductor manufacturing process and, in particular, when numerous printing elements that are to be made to correspond to the printing width are arrayed over the entire area of a base, it is very difficult to manufacture all of the printing elements without any defects. As a consequence, the manufacturing yield of the process for manufacturing the printhead is poor and is accompanied by higher cost. There are occasions where such a printhead cannot be put into practical use because of the costs involved.

Accordingly, methods of obtaining a full-line printhead have been disclosed in the specifications of Japanese Patent Application Laid-Open (KOKAI) Nos. 55-132253, 2-2009, 4-229278, 4-232749 and 5-24192 and in the specification of U.S. Pat. No. 5,016,023. According to these methods, a number of high-yield printheads each having an array of printing elements of a comparatively small number of orifices, e.g., 32, 48, 64 or 128 printing elements, are placed upon (or upon/below) a single base at a high precision in conformity with the density of the array of printing elements, thereby providing a full-line printhead whose length corresponds to the necessary printing width.

It has recently become possible on the basis of this technique to simply manufacture a full-line printhead by arraying printing elements of a comparatively small number (e.g., 64 or 128) of orifices on bases (also referred to as "printing units") and bonding these printing units in a row on a base plate in highly precise fashion over a length corresponding to the necessary printing width.

Though it has thus become easy to manufacture a full-line printhead, certain performance-related problems remain with regard to a printhead manufactured by the foregoing manufacturing method. For example, a decline in printing quality, such as density unevenness, cannot be avoided. The cause is a variation in performance from one printing unit (base) to another in the row of such printing units, a variation in the performance of neighboring printing elements between the arrayed printing units and heat retained in each driving block at the time of recording.

In particular, in the case of an ink-jet printhead, not only a variation in the neighboring printing elements between the arrayed printing units but also a decline in ink fluidity owing to the gaps between printing units results in lower yield in the final stage of the printhead manufacturing process. For this reason, the state of the art is such that these printheads are not readily available on the market in large quantities regardless of the fact these printheads exhibit highly satisfactory capabilities.

As means for correcting density unevenness caused by the printhead, Japanese Patent Application No. 6-34558 discloses a method of correcting the unevenness in the density of a printhead by measuring dot diameter and correcting unevenness based upon the results of measurement. However, there is a room for improving reproducibility of printed dots. For example, when one line of printing has been performed, the characteristics of the printed dots change subtly on the next line, over then next several dozen lines and over the next several hundred lines. (This is known as "fluctuation" from dot to dot.) However, since a specific phenomenon (dot diameter) which incorporates this fluctuation is conventionally employed as information regarding density unevenness, it is difficult to obtain satisfactory results with a single correction. In order to acquire the desired image quality, it is required that printed dot data from several measurements be acquired to perform the correction. In a case where electrical energy is converted to thermal energy in conformity with correction data, energy which is larger than usual is applied to the printing elements that exhibit a low density. Thus, there is still a room for further improving reliability in terms of the durability of the printhead.

Furthermore, it has been sometimes impossible to assuredly correct the density unevenness according to a method for predicting on the basis of OD values, which is one of conventional density unevenness correction methods, since there has been some unevenness in manufacturing each of printheads and the method does not show a good correlation.

Also, if one reference OD value is selected on the basis of a phenomenon due to the combinations of driving control pulses for n times, the density unevenness can be corrected when the range of the density unevenness is small, however, there has been a limitation for correcting the density unevenness over the wide range of variation of density.

SUMMARY OF THE INVENTION

Accordingly, it is an object of the present invention to provide a method and an apparatus for assuredly and rapidly correcting a printing characteristic of a printhead.

It is another object of the present invention to provide a high yield and low cost printhead, whose characteristic is corrected by the above apparatus, and a printing apparatus capable of accurately correcting density unevenness without overload of the printhead.

According to one aspect of the present invention, the foregoing object is attained by providing an apparatus for correcting a printing characteristic of a printhead having a plurality of printing elements and memory means for storing data, comprising: printing control means for using the printhead, using n kinds of printing control signal patterns and experimentally printing a printing pattern in response to the printing control signal patterns on a printing medium; reference density generating means for generating a reference density distribution on the basis of one of n kinds of the printing patterns printed on the printing medium; selecting means for selecting one of the n kinds of printing control signal patterns for each of the printing elements such that a density value for each pixel is equal to or close to the reference density distribution; optimizing means for controlling the reference density generating means so as to generate a reference density distribution different from the initially generated reference density distribution on the basis of another one of the n kinds of the printing patterns printed, controlling to make a selection by the selecting means of the reference density distribution different from the initially generated reference density distribution created and selecting an optimum one of the n kinds of printing control signal patterns; and transmitting means for determining an optimum printing control signal selected by the optimizing means as correction data and transmitting the correction data to the memory means of the printhead.

According to another aspect of the present invention, the foregoing object is attained by providing a method of correcting a printing characteristic of a printhead having a plurality of printing elements and a memory unit for storing data, said method comprising: a printing control step for using the printhead, using n kinds of printing control signal patterns and experimentally printing a printing pattern in response to the printing control signal patterns on a printing medium; a reference density generating step for generating a reference density distribution on the basis of one of n kinds of the printing patterns printed on the printing medium; a selecting step for selecting one of the n kinds of printing control signal patterns for each of the printing elements such that a density value for each pixel is equal or close to the reference density distribution; an optimizing step for controlling the reference density generating step so as to generate a reference density distribution different from the initially generated reference density distribution on the basis of another one of n kinds of the printing patterns printed, controlling to make a selection at the selecting step of the reference density distribution different from the initially generated reference density distribution and selecting an optimum one of the n kinds of printing control signal patterns; and a transmitting step for determining an optimum printing control signal selected at the optimizing step as correction data and transmitting the correction data to the memory unit of the printhead.

According to still another aspect of the present invention, the foregoing object is attained by providing a printhead whose characteristic is corrected by the above-mentioned apparatus.

According to still another aspect of the present invention, the foregoing object is attained by providing a printing apparatus using the above-described printhead comprising: receiving means for receiving the correction data from the printhead; control means for generating a control signal for controlling the operation of the driving means so as to form uniform pixels respectively by the plurality of printing elements on the basis of the correction data; and transmitting means for transmitting the control signal to the printhead.

In accordance with the present invention as described above, a printhead having a plurality of printing elements and a memory unit capable of storing information is used, n kinds of printing control signal patterns are used to print experimentally printing patterns in response to the printing control signal patterns on a printing medium, a reference density distribution is generated on the basis of one of n kinds of printing pattern images printed and one of the n kinds of printing control signal patterns is selected for each of the printing elements such that a density value for each pixel is equal to or close to the reference density distribution. Further, a different reference density distribution from the above-described reference density distribution is generated on the basis of another one of, the n kinds of the printing pattern images printed and a control is carried out so that the above-mentioned selection is made for the different reference density distribution. As a consequence, an optimum printing control signal pattern is selected from a plurality of printing control signal patterns thus obtained.

Then, the selected optimum printing control signal is determined as correction data and the correction data is transmitted to the memory unit provided in the printhead.

Further, the printhead whose printing characteristic is corrected as mentioned above is mounted on a printing apparatus. Then, the printing apparatus receives the correction data stored in the memory means of the printhead, generates a control signal for controlling the operation of driving means provided in the printhead so that a plurality of printing elements of the printhead respectively form uniform pixels on the basis of the correction data, and transmits the control signal to the printhead.

The present invention is particularly advantageous since the correction data can be created by one cycle of experimental printing without repeating cycles of the experimental printing of n kinds of printing patterns, the formation of the correction data and the verification thereof. Therefore, a correction process can be more rapidly carried out.

Furthermore, in the printing apparatus on which the printhead whose characteristic is corrected as mentioned above is mounted, a printing operation of high quality can be performed without having any density unevenness for each of the printed pixels.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENT

A preferred embodiment of the present invention will now be described in detail with reference to the accompanying drawings.

Overview of the Apparatus

Figure 1:
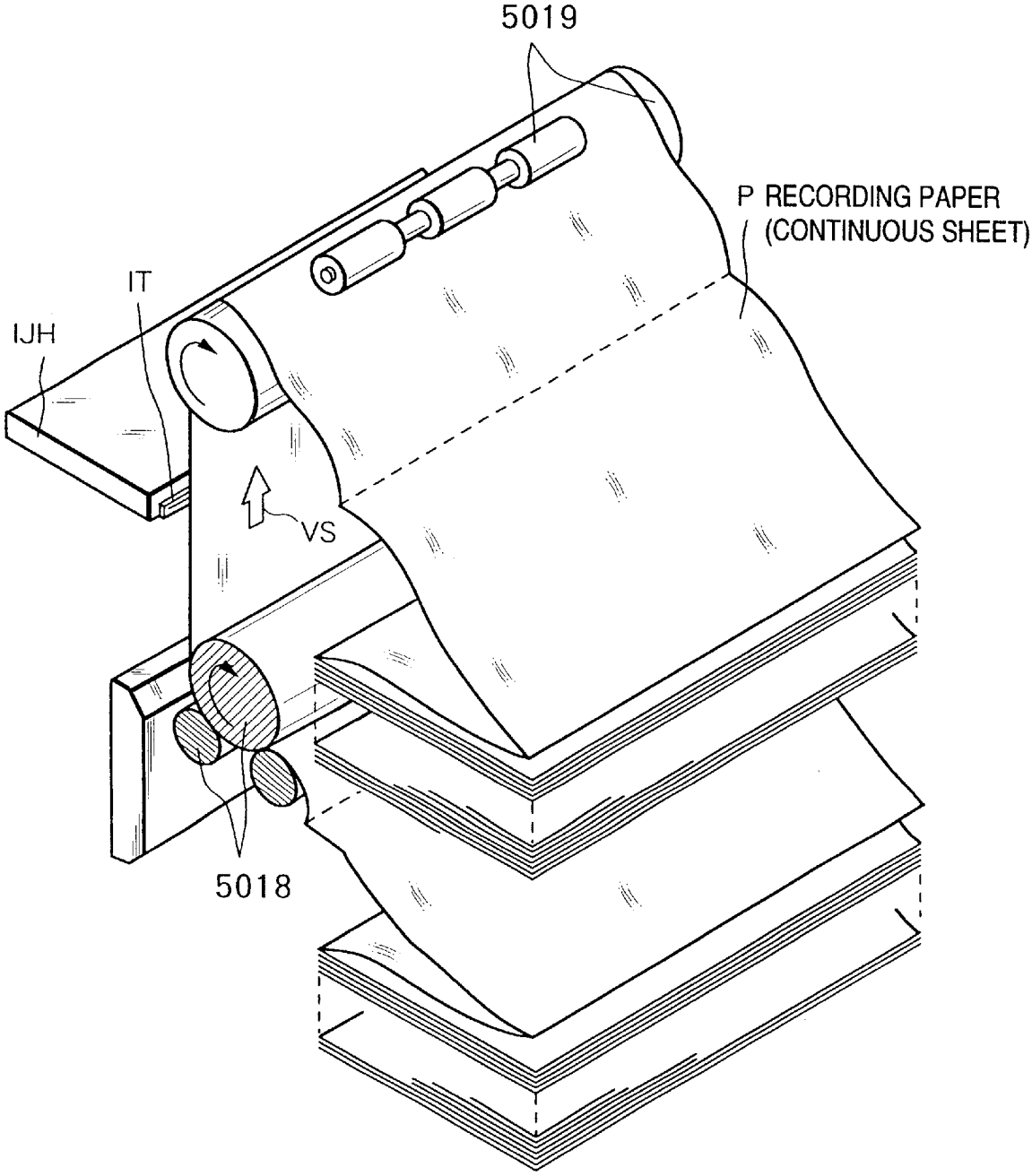
FIG. 1 is a general view of a full-line ink-jet printer, which is a typical embodiment of the present invention.

FIG. 1 is an external perspective view showing the principal portions of an ink-jet printer IJRA, which is a typical embodiment of the present invention. As shown in FIG. 1, the printer has a printhead (a full-length multiple printhead) IJH arranged along a range of full width of recording paper (a continuous sheet) P. The printhead IJH discharges ink over a range extending across the full width of the recording paper P. The ink is discharged toward the recording paper P from an orifice IT of the printhead at a prescribed timing.

In this embodiment, the continuous sheet of foldable recording paper P is conveyed in the direction VS in FIG. 1 by driving a conveying motor under the control of a control circuit, described below. An image is printed on the recording paper. The printer in FIG. 1 further includes sheet feeding rollers 5018 and discharge rollers 5019. The discharge rollers 5019 cooperate with the sheet feeding rollers 5018 to hold the continuous sheet of recording paper P at the printing position and operate in association with the sheet feeding rollers 5018, which are driven by a drive motor (not shown), to feed the recording paper P in the direction of arrow VS.

Figure 2:
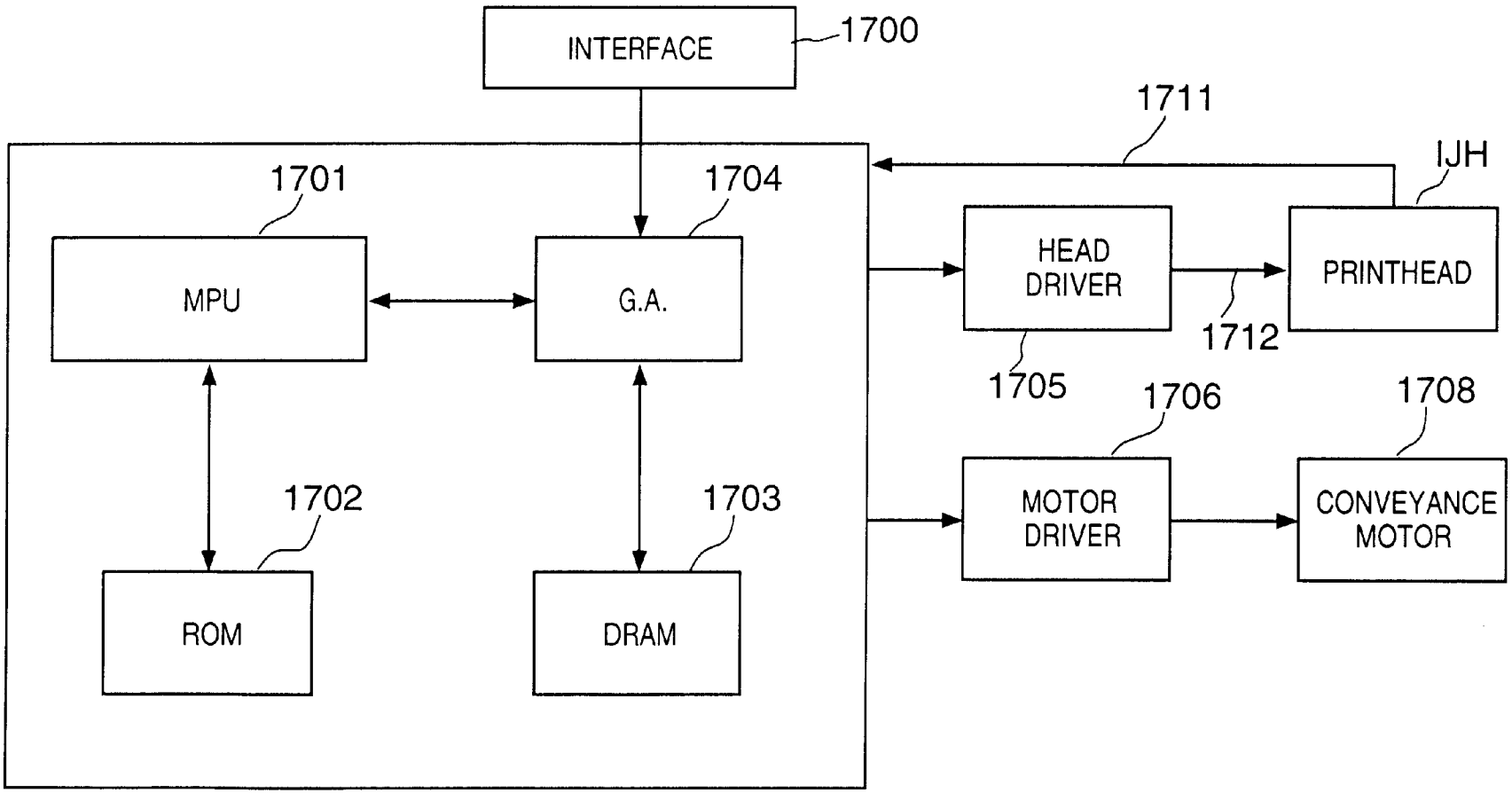
FIG. 2 is a block diagram showing a control configuration for executing control of printing in the ink-jet printer.

FIG. 2 is a block diagram illustrating the construction of the control circuit of the ink-jet printer. Shown in FIG. 2 are an interface 1700 for entering a printing signal from an external device such as a host computer, an MPU 1701, a ROM 1702 for storing a control program (inclusive of character fonts as necessary) executed by the MPU 1701, a DRAM 1703 for temporarily saving various data (the above-mentioned printing signal and printing data that are applied to the printhead), and a gate array (G.A.) 1704 for controlling supply of printing data to the printhead IJH. The gate array 1704 also controls transfer of data among the interface 1700, MPU 1701 and RAM 1703. Also shown are a conveyance motor 1708 for conveying recording paper (the continuous sheet in this embodiment), a head driver 1705 for driving the printhead IJH, and a motor driver 1706 for driving the conveyance motor 1708.

As for the general operation of the above-mentioned control circuit, the printing signal enters the interface 1700, whereupon the printing signal is converted to printing data for printing between the gate array 1704 and MPU 1701. The motor driver 1706 is driven into operation and the printhead IJH is driven in accordance with the printing data sent to the head driver 1705. As a result, a printing operation is carried out.

Figure 14:
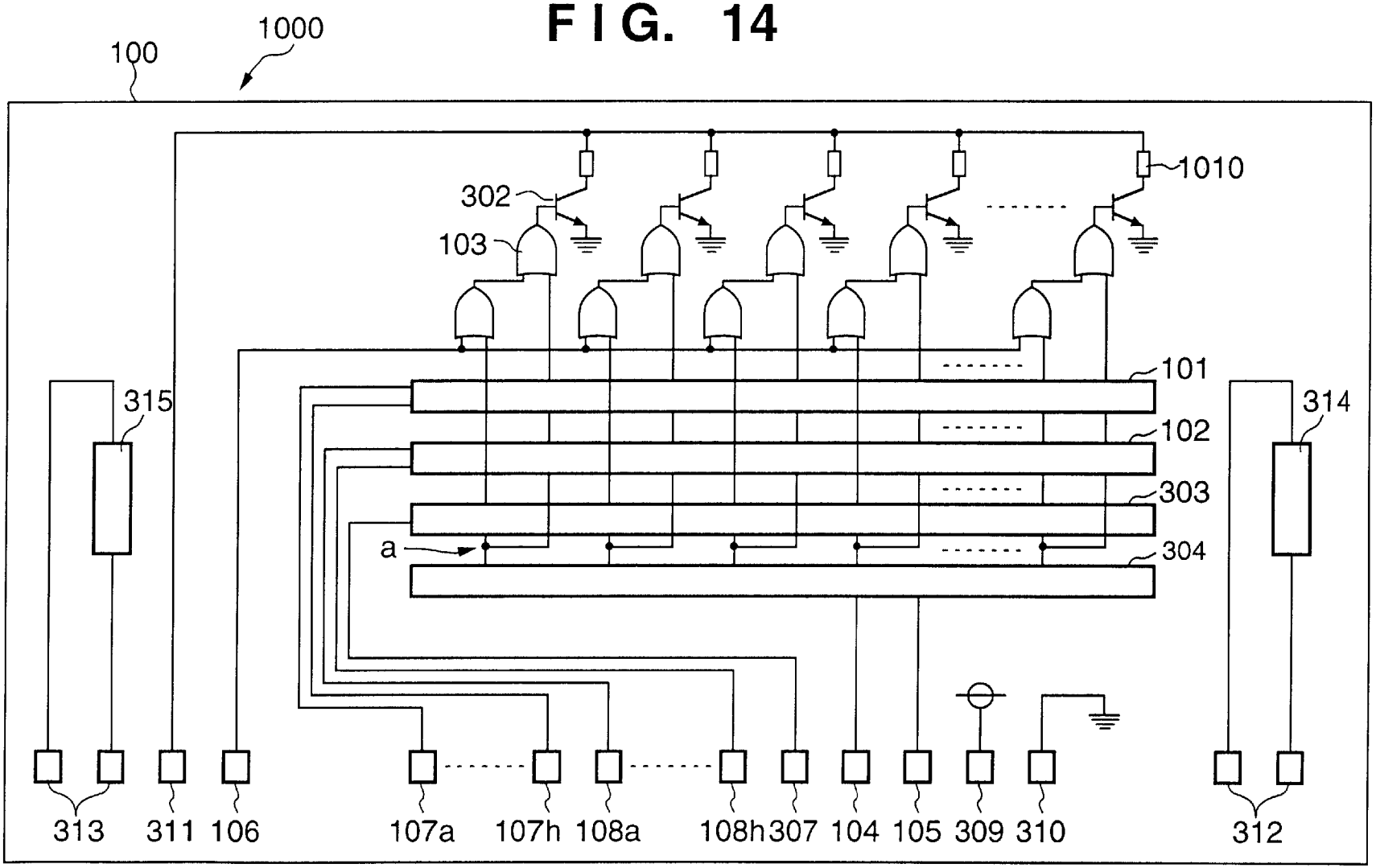
FIG. 14 is a diagram showing an example of the circuit arrangement of a drive circuit provided on the heater board for the printhead.

Numeral 1711 denotes a signal line for monitoring sensors (e.g., a heating-resistor sensor 314 and a temperature sensor 315, which are shown in FIG. 14) of each board, and for transmitting correction data from a memory 13 (described later) storing correction data which corrects for a variation in each board (heater board 1000, described later) provided within the printhead IJH. Numeral 1712 denotes a signal line for carrying preheating pulses, latch signals and heating pulses. On the basis of the correction data from the memory 13 in the printhead IJH, the MPU 1701 sends the printhead IJH a control signal via the signal line 1712 in such a manner that the boards are capable of forming uniform pixels.

Figure 3:
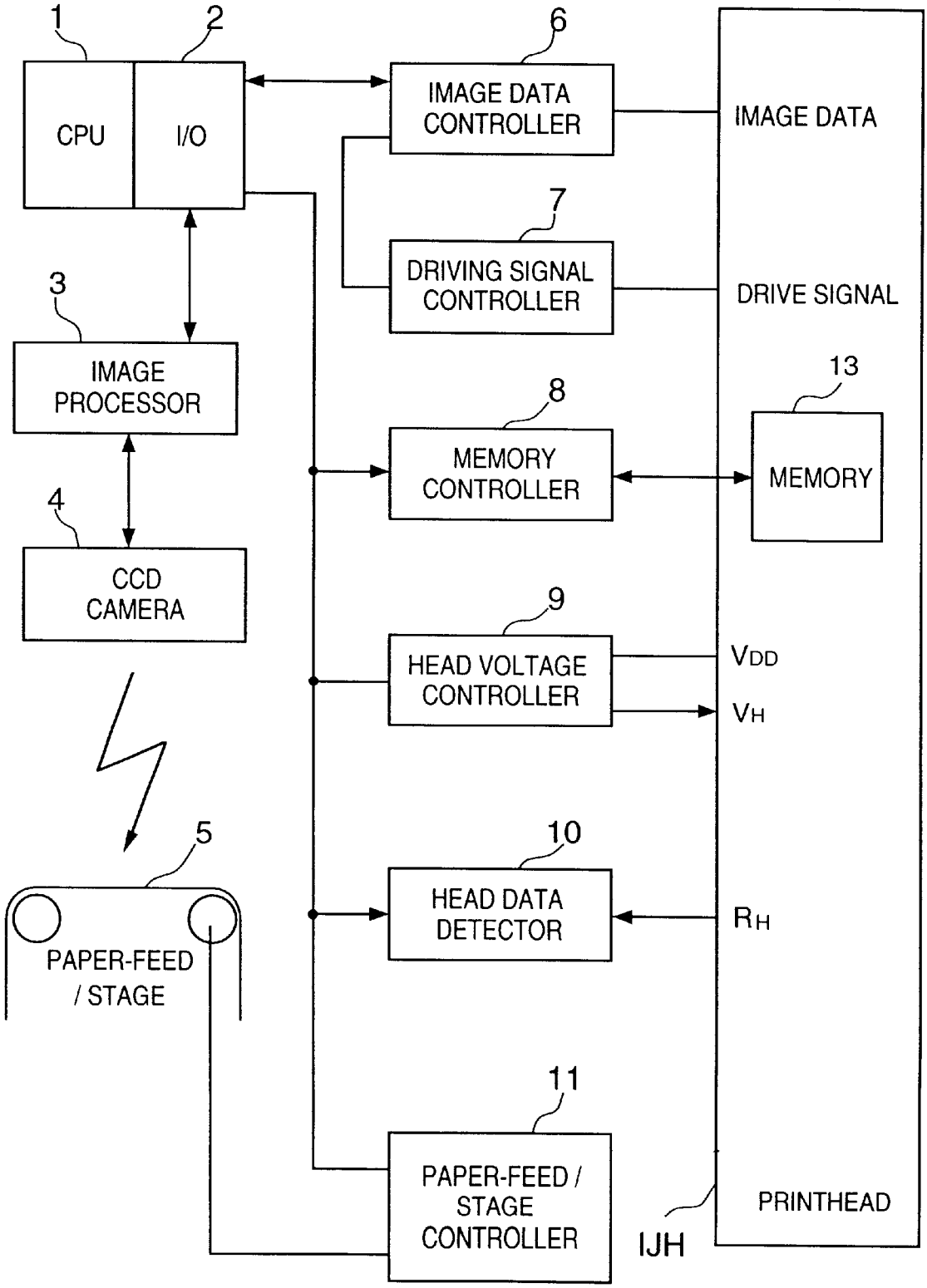
FIG. 3 is a block diagram showing the construction of a printhead correction apparatus.

FIG. 3 is a block diagram illustrating the construction of the printhead correction apparatus of this embodiment. An I/O interface 2 interfaces the CPU 1 with the various controllers of the apparatus. An image processor 3 uses a CCD camera 4 to read the printing dot pattern on a recording medium placed upon a paper feeding stage 5 and converts the dot diameter and density unevenness of the dot pattern to pixel values. When the dot data corresponding to all printing elements of the printhead IJH is sent from the image processor 3 to the CPU 1, the latter operates upon the dot data, sends density correction data to a driving signal controller 7 in conformity with a drive signal for driving the printhead IJH and causes a memory controller 8 to develop the density correction data.

An image data controller 6 outputs a dot pattern to be recorded to the printhead IJH. The controller 6 transmits a density correction drive signal while sending a synchronizing signal to the drive signal controller 7 not only at the time of ordinary printing but also when the density correction data has been determined. The CPU 1 manages a head voltage controller 9 which controls the driving voltage of the printhead IJH and manages a stage/paper-feed controller 11 for controlling the operation of the paper feeding stage 5, thereby setting a proper drive voltage and controlling stage movement and paper feed. Furthermore, a head data detector 10 is an important component which feeds back, for the purpose of density correction, the characteristics of each board (printing unit) 1000 (see FIG. 10) within the printhead IJH.

In the printhead IJH which, by way of example, is composed of a row of a plurality boards 1000 on which 64 or 128 printing elements have been disposed, it is not known from which portions of a silicon wafer or the like the boards 1000 have been cut. Accordingly, there are cases in which the characteristics differ from one board to another.

In such case, a rank detecting resistor element RH having a surface resistivity (Ω/□) identical with that of the printing element is provided in each board 1000 in order that all printheads can perform printing at an uniform density. There are also cases in which a semiconductor element capable of monitoring a change in temperature is provided for each board 1000. The head data detector 10 monitors these elements. When the head data detector 10 sends data obtained by monitoring these elements to the CPU 1, the latter generates correction data, which corrects the data that drives each of the boards 1000, in such a manner that each board 1000 in the printhead can print at a uniform density. The rank mentioned here is a parameter obtained by quantifying the characteristic of each board 1000.

When the above-mentioned correction data is reflected in each controller of the printhead correction apparatus, the printing operation by the printhead IJH is executed under these conditions. In the correcting apparatus, the results of printing are again subjected to image processing by the CCD camera 4 and image processor 3, and the memory controller 8 writes the final correction data in the memory 13 (a non-volatile memory such as an EEPROM) at a stage at which the predetermined criteria of the printhead are satisfied.

Figure 4:
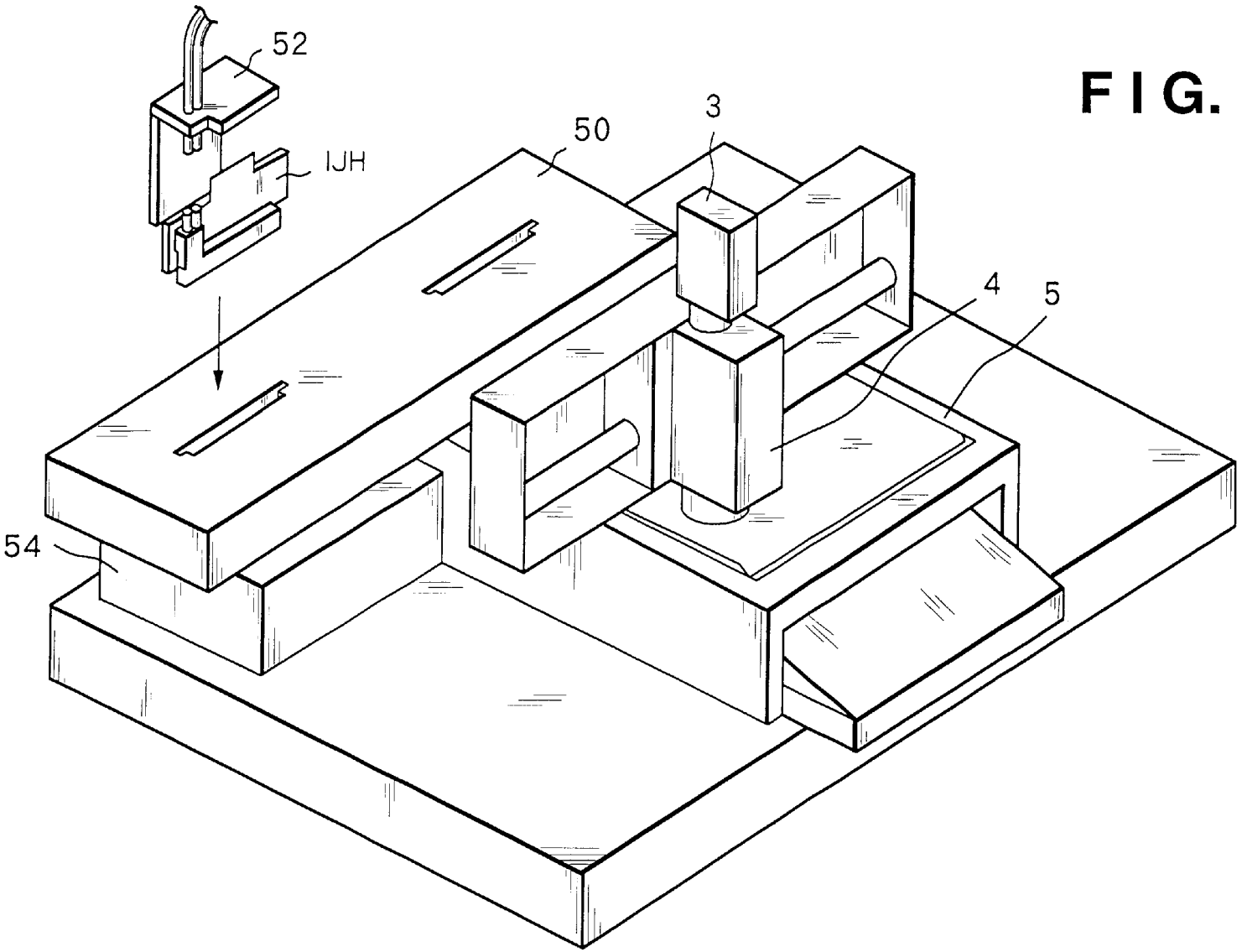
FIG. 4 is a perspective view showing the general construction of the printhead correction apparatus.
Figure 5:
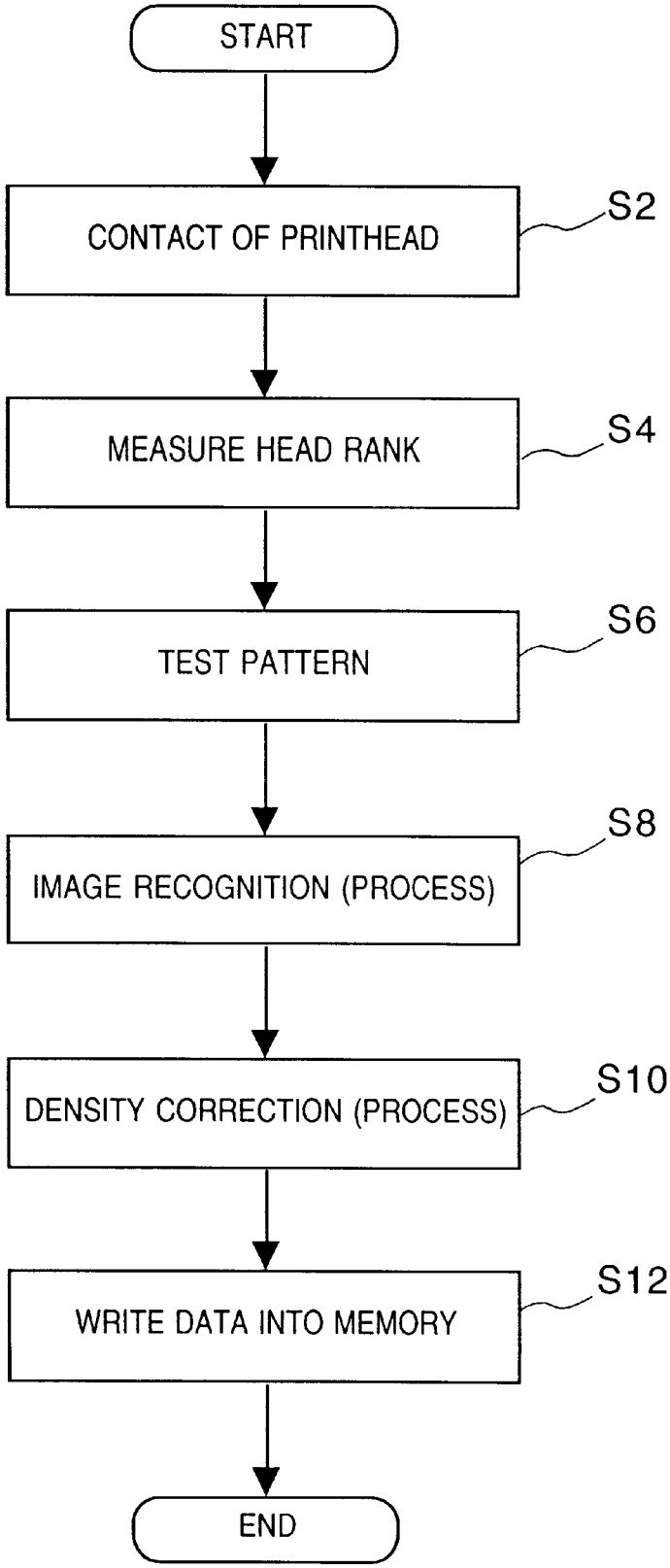
FIG. 5 is a flowchart showing the operation of the printhead correction apparatus.

FIG. 4 is an external perspective view showing the construction of the printhead correction apparatus, and FIG. 5 is a flowchart illustrating the operation of the apparatus. Operation will now be described with reference to FIGS. 4 and 5.

In step S2, initially, a printhead IJH is mounted on a fixing base 50. A CPU 1 operates the fixing base 50 and fixes the printhead IJH onto the fixing base 50 so that the printhead IJH carries out a printing operation at a normal position. At the same time, an electrical contact is connected to the printhead IJH and an ink feeder 52 is connected to the printhead IJH.

Subsequently, in step S4, a sheet resistance value of a substrate 1000 is monitored in order to measure the rank of the printhead IJH. In case of a full line printhead unit, a plurality (for instance, 24 pieces) of substrates 1000, each having 128 nozzles, are arranged sideward, as mentioned below, to configure the full line printhead. Accordingly, the discharge characteristics of ink differ in the respective substrates. For this reason, the sheet resistance value of each substrate is monitored. Then, driving power (a prepulse width, a main pulse width and a pulse interval between these pulses) which establishes an individual reference for each substrate to carry out a double pulse control is determined on the basis of the monitored values.

In this embodiment, four different driving power values deviating from the value of a reference driving power which is obtained for each nozzle of each substrate can be set. These four values are referred to as ranks (hereinafter, it is assumed that the rank values are "1", "2", "3" and "4"). The specific combination values of the prepulse width, the main pulse width and the pulse interval between these pulses correspond respectively to the rank values. Further, the data of the rank values can be stored in the memory 13. As mentioned above, since the ink discharge characteristics of respective substrates change considerably depending on variation in their manufacturing or the like, driving power serving as an optimum reference for each substrate is determined. Therefore, the rank value "1" of one substrate does not need to be equal to the reference driving power (that is to say, the prepulse width, the main pulse width and the pulse interval between these pulses) of the rank value "1" of another substrate.

In such a way, since the reference driving power can be determined for each substrate, optimum driving power can be determined for each of all the nozzles forming the printhead IJH on the basis of the combinations of the reference driving power corresponding to each of the substrates, and the rank values for the nozzles of the respective substrates.

Further, in step S6 in this embodiment, the rank values are changed on the basis of the rank values determined in the step S4 and four kinds of test patterns are printed. As a preprocessing for printing the test patterns, a preliminary printing operation (aging) is carried out so as to make a stable printing operation until the operation of the printhead IJH is stabilized. The aging operation is performed on an aging tray provided near a head recovery processing unit 54 and a recovery process (suction of ink, cleaning of an orifice surface, etc.) is carried out so as to print the test patterns in a normal state.

When the test patterns are printed in the step S6, the printed results are conveyed to the positions of a CCD camera 4 and an image processing unit 3. The process advances to step S8 to input an image by these devices. Image processing data thus inputted is converted to density data (OD values) by using a pre-stored look-up table.

Further, in step S10, the density data is compared with parameters for evaluation of printing. In particular, a computation process is carried out by taking the below-mentioned factor into consideration with respect to the density unevenness, of the printing elements, which can be improved, so that density correction data is generated. Note that the step S10 will be described below in more detail.

Density unevenness of an image is produced by a difference in relative density contrast in printing performed by printing elements. The smaller the contrast, the less noticeable density unevenness is to the eye. When printing elements which produce a high-density printing are concentrated somewhat close together in space, the occurrence of density unevenness becomes apparent.

When the limit on visual discriminating ability is put into the form of a formula from the viewpoint of density unevenness, the following relation is obtained from experiment:

$$\Delta OD=0.02\times\Delta Vd$$

(where Vd is the amount of ink discharge.) This equation shows that a disparity in amount of discharge of 1~4 pl (picoliters) results in a change of 0.02~0.08 in terms of the OD value. In an actual image, density unevenness results from a collection of printing dots causing variation. If a difference in amount of ink discharge on the order of 4 pl occurs between mutually adjacent printing elements, a fairly large difference in contrast is produced between these printing elements. However, in case of a printing density on the order of 300~600 dpi, it is impossible for the human eye to compare density unevenness between mutually adjacent dots in dot units.

When the discriminating limit of the human eye with respect to density unevenness in an image is taken into account, density unevenness data near the discriminating ability of the human eye can be created by:

(1) performing a density unevenness correction in units of several dots (two to eight pixels, depending upon printing density); and (2) increasing the number of events of image processing (the number of events per printed dot or the number of events in a group of printed dots (16~1024 dots)).

A procedure for creating such density unevenness data will now be described in detail.

Figure 6:
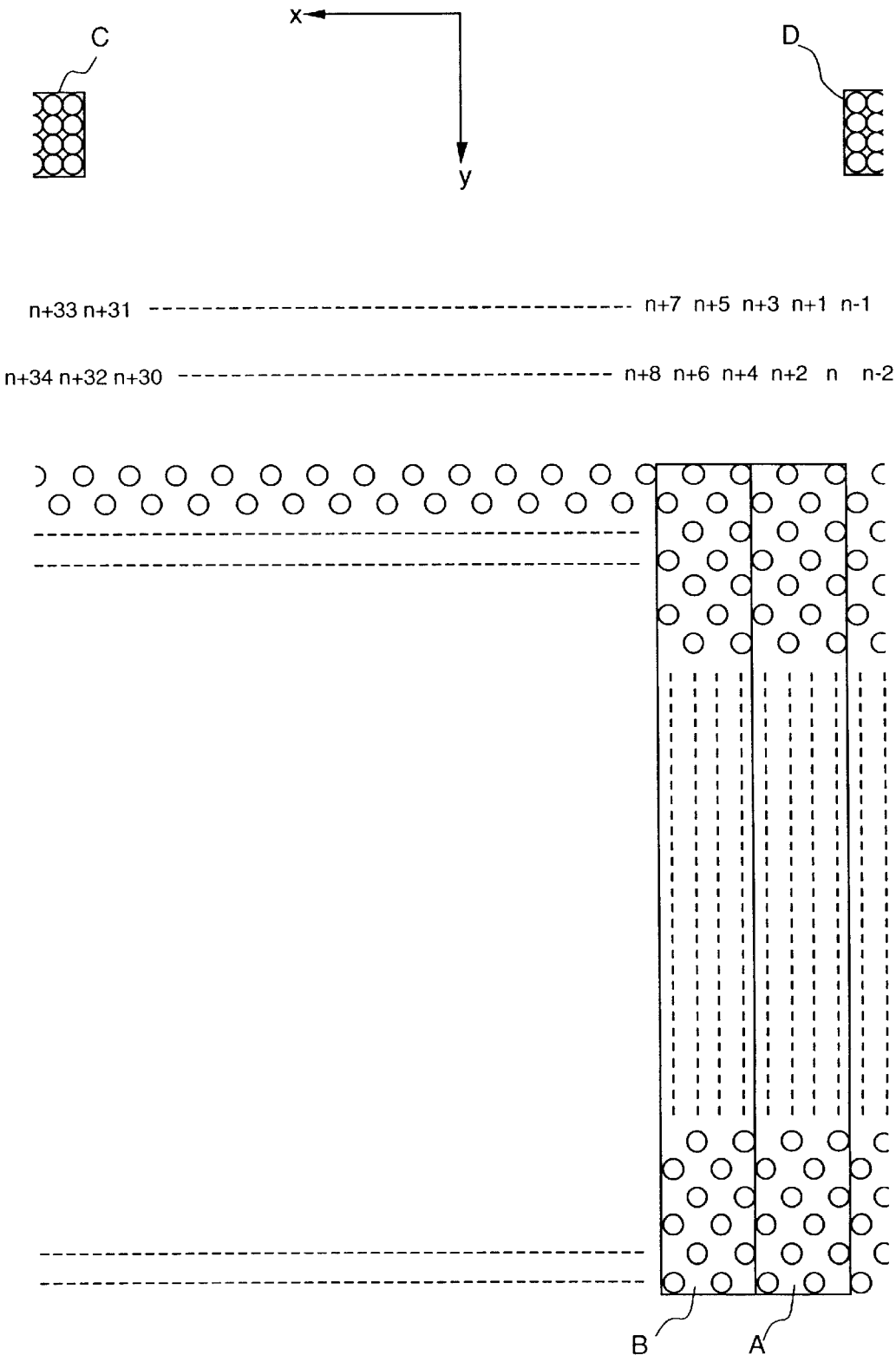
FIG. 6 is a diagram illustrating a test pattern for correcting density.

FIG. 6 illustrates an example of an image pattern read by a CCD camera or the like. In FIG. 6, a dot pattern having a 50% duty is formed and a dot pattern of 32 dots×32 dots is allocated to the screen area of the CCD camera. In FIG. 6, A and B are areas of 4×32 dots each. In this embodiment, each is one event. Further, C and D in FIG. 6 are disposed as markers for image recognition of the dot pattern of 32×32 dots.

Let n represent the first dot read. The area A constituting one event is composed of a collection of 32 bits in the y direction (the direction in which the recording medium is conveyed) from n to n+3 in the x direction (the column direction of the printing elements). Eight similar areas are produced in an image memory (not shown), and binarizing processing is performed in each area in accordance with the number of "black" or "white" pixels in the area and a predetermined threshold value. It should be noted that an optimum value obtained experimentally is used as the atthreshold value. As the result of this binarizing processing, in a case of FIG. 6, density unevenness data is obtained for every four dots in the x direction.

Further, adopting the absolute density (the total number of black pixels) in each area as the density unevenness data also is effective.

Furthermore, an image having an area corresponding to more than 100 dots per one nozzle of a printing element can be read in and processed by an image scanner, wherein the dot pattern has the 50% duty shown in FIG. 6, and the processed results can be used as the density unevenness data.

Since an event number of more than 100 dots (100 printing operations) per nozzle is obtained with this method, a subtle fluctuation in dot diameter in relation to the y direction is averaged (Note that such a processing is called a smoothing processing). When density unevenness is discriminated by the human eye, the fluctuation in the y direction is not very noticeable. However, when the number of events is small, the density unevenness does not become a density unevenness that can be visually recognized by the human eye and is not appropriate as density unevenness data. The reason is that the data does not become statistical data that is meaningful to the extent that it can be visually discerned by the human eye. If density unevenness data in dot units is obtained in the x direction, several dots of the data can be collected and adopted as density unevenness data. In this case an arrangement may be adopted in which it is possible to externally set the number of dot units. In order to create correction data in units of four dots, as mentioned above, the density unevenness data in units of four dots in the x direction may be averaged.

The density unevenness data thus obtained does not have a complicated structure and can be processed in a short period of time in both a printhead manufacturing apparatus and a printer.

With regard to the density unevenness data every four dots obtained as described above, the same data is provided for every four nozzles of the printing. It goes without saying that, if the same data is provided for every eight (8) nozzles or sixteen (16) nozzles, for example, the device configuration of the printhead for supplying such data can be simplified. In other words, the larger the interval to which the same data is supplied becomes, the smaller the latch circuit of the printhead becomes. As a result, the size of a heater board can be reduced.

When density unevenness data is thus obtained, how each element is to be corrected is decided based upon this data. For example, in a case where the driving power of each recording element of the printhead is decided by pulse width, driving pulse-width data applied to an integrated circuit for driving the printhead is selected. In a case where such data is selected from several pulse widths, the maximum value (MAX) and minimum value (MIN) of the pulse width selected are decided and a pulse width between these values is set based upon the resolution allowed. The pulse width is set so as to correct the printing density of each element in conformity with the image processing data, and the pulse width is made to correspond to each printing element, whereby it is possible to average the printing densities of the printhead unit.

When the density correction data is obtained as above, the process advances to step S12 to store the data in the memory 13.

In a case where the density unevenness is corrected, since it goes without saying that a correction suitable for the printing state particular to each printhead needs to be done, it is desirable to generate the correction data on the basis of the density unevenness appearing on an actual print pattern.

Thus, in the present embodiment, when the density unevenness correction data is generated, different test printing operations are performed n times by taking the characteristic of the printhead into account. Here, as mentioned above, the test patterns are printed four times in the step S6.

In printing by a printhead according to an inkjet printing method, it has been experimentally recognized that the ink droplets discharged from the printhead can be modulated in a varied way by applying energy according to a double pulse control method.

Figure 7:
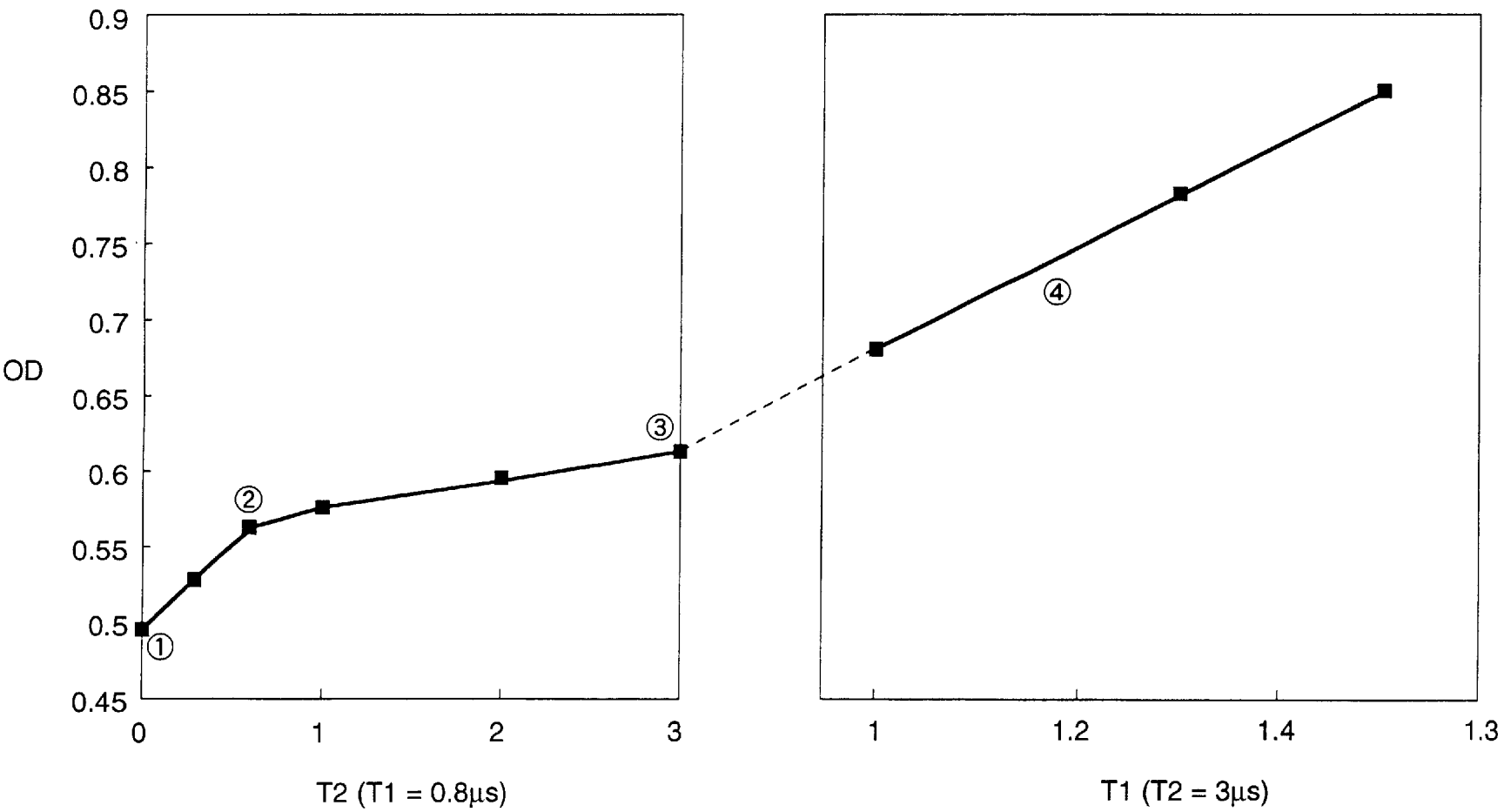
FIG. 7 is a diagram showing the relation between OD values and preheat pulses (T1) and pulse intervals (T2)

FIG. 7 is a diagram showing the relation between the change of a prepulse width (T1) and a pulse interval width (T2) between a prepulse and a main pulse and the change of OD values.

In particular, preheat pulses (prepulse) are combined with discharge pulses (main pulse) having different pulse width therefrom, so that a modulation of the OD value as large as 0.3 can be attained. Further, if the pulse interval (3 to 4 $\mu$sec at maximum) between the prepulse and the main pulse is decreased, the amount of ink discharge can be made smaller, and if the pulse interval is increased, the amount of ink discharge can be made larger.

FIG. 7 indicates that, within a certain range of OD values (for instance, OD=0.5 to 0.6 or so), the prepulse is fixed to a standard value (for instance, T1=0.8 $\mu$s) and the density unevenness correction can be carried out only by the change of the pulse interval (T2=0 to 3 $\mu$s). Such a control is significantly effective from the viewpoint of enhancing the durability of the printhead or reducing consumed electric power.

However, in practice, some nozzles deviating from the above OD value correction range exist within a range of variation in manufacturing. The printing characteristic of these nozzles are corrected by changing the prepulse width. For example, as shown in FIG. 7, the pulse interval (T2) is fixed to 3 $\mu$s and the prepulse width (T1) is changed so that the OD values are changed.

In the meantime, the test printing operations performed n times indicate experimental printing operations by selecting n kinds of driving controls obtained from a variety of combinations of the prepulse width (T1) and the pulse interval (T2). For example, in case of n=4, there are four combinations of driving control pulses. It is assumed that the combinations of these pulses are ① to ④ shown in FIG. 7. Needless to say, the test printing operations can be carried out 10 times or more. In other words, the combinations of 10 kinds of driving control pulses may be employed as the calculation reference of density unevenness correction data. As can be seen from the tendency of graphs shown in FIG. 7, however, the approximate values obtained by a linear approximation on four points can be sufficiently utilized as predicted data.

Figure 8A:
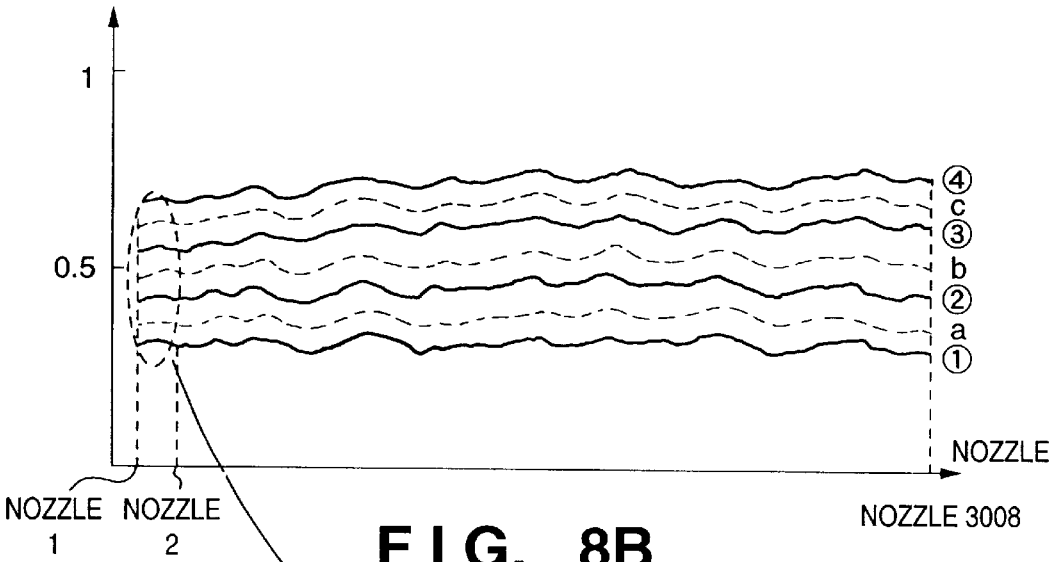
FIGS. 8A and 8B are diagrams showing the change of OD values for each of nozzles obtained according to different driving control parameters.
Figure 8B:
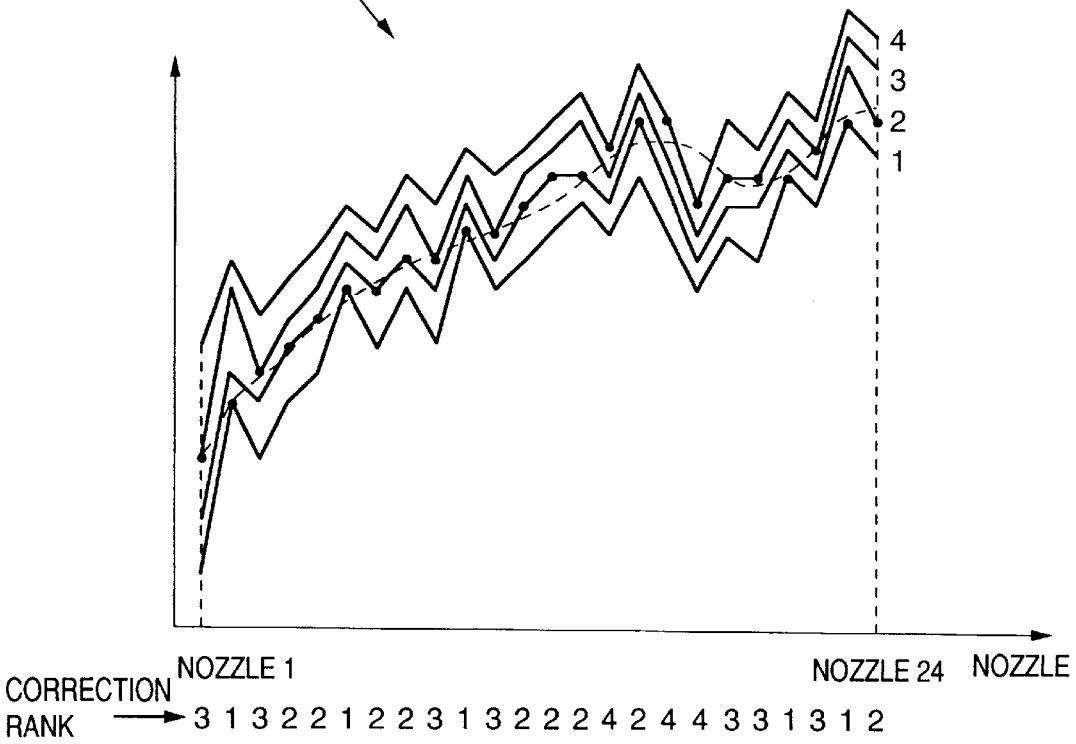

FIGS. 8A and 8B are diagrams showing the change of OD values for each nozzle.

FIG. 8A macroscopically shows the change of the OD values for each nozzle obtained from an image printed by four sets of driving control pulses (indicated by, for instance, ① to ④ in FIG. 7) throughout the entire part of a full line printhead having 3008 nozzles illustrated in FIG. 10 as mentioned below. In FIG. 8A, a to c designate OD values calculated and predicted from the combinations of driving control pulses obtained from the above-described linear approximation calculation.

FIG. 8B is a diagram microscopically showing the change of OD values for each nozzle of the full line printhead. Here, the change of the OD values of the nozzles 1 to 24 among the nozzles of the full line printhead is shown in correspondence to the respective rank values represented by numeric characters "1", "2", "3" and "4". As described before, since the full line printhead is provided with a plurality of substrates having 128 nozzles, the nozzles 1 to 24 are located on one substrate. Accordingly, the difference in rank value in FIG. 8B represents the absolute difference of driving power (namely, a prepulse width, a main pulse width and a pulse interval between these pulses). The rank values may correspond to actually measured driving control pulses shown in FIG. 8A or to predicted driving control pulses.

As can be seen from FIG. 8B, when the change of the OD values of the printhead is microscopically viewed, the values greatly fluctuate.

Figure 9:
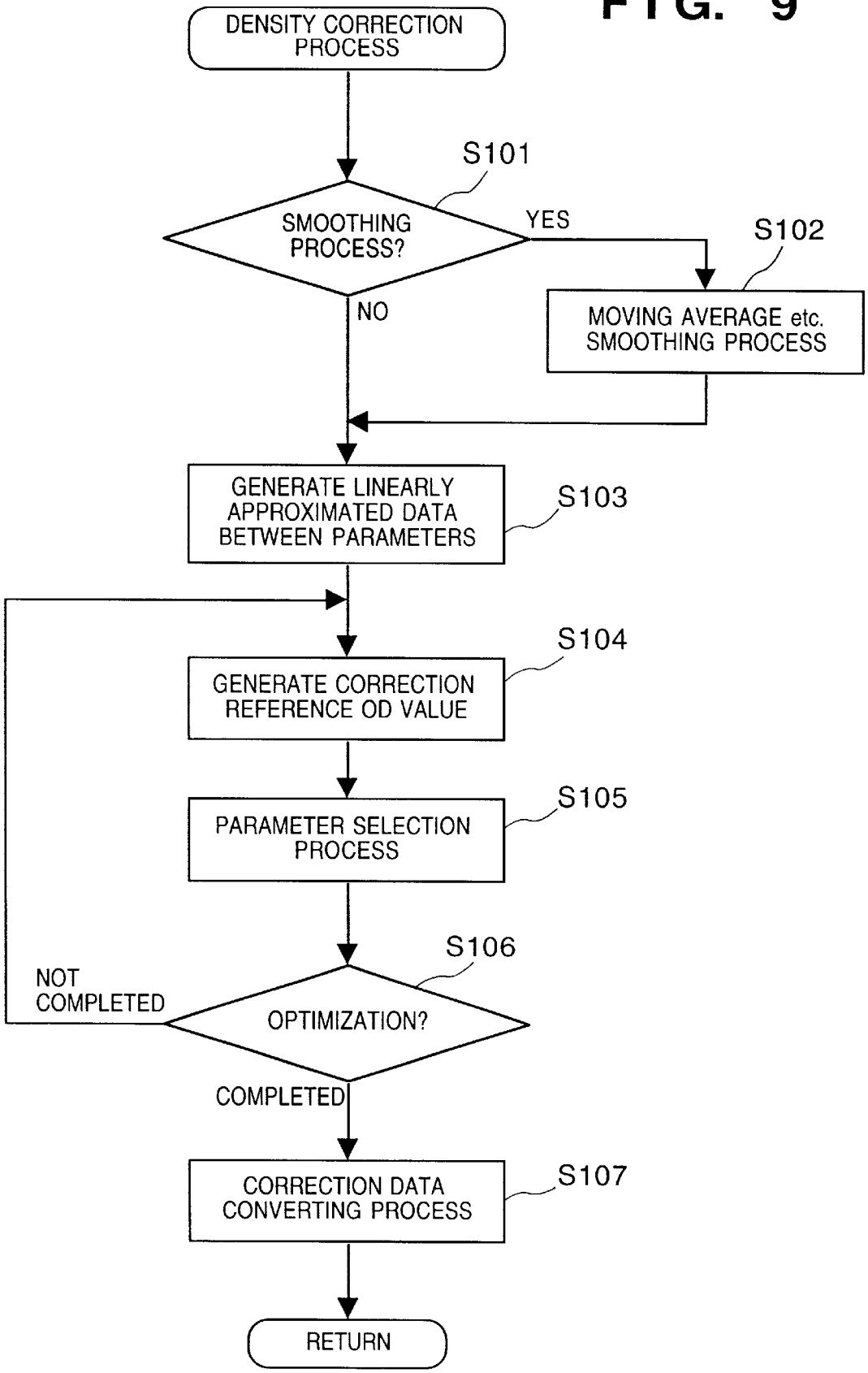
FIG. 9 is a flowchart showing processes for generating density unevenness correction data.

Now, processes for generating density unevenness correction data executed on the basis of the data shown in FIG. 7 or FIGS. 8A and 8B will be explained with reference to a flowchart shown in FIG. 9. FIG. 9 shows the detail of the process of the step S10 shown in FIG. 5.

In the processes for forming the density unevenness correction data, it is first decided whether or not the obtained density unevenness data (OD values) is smoothed (step S101). When a smoothing process is somewhat applied to the density unevenness data, the process advances to step S102 to obtain a moving average of several nozzles located before and after a designated nozzle and the data is smoothed. Then, the process advances to step S103. On the other hand, when a smoothing process is not carried out, the process advances to the step S103.

Next, in the step S103, predicted OD value data is calculated in a case where the combination of driving control pulses is changed n times (in this embodiment, n=4), and some of the predicted OD value is prepared. More specifically, the predicted OD data is calculated by using the linear approximation as mentioned above on the basis of driving power (a prepulse width, a main pulse width and a pulse interval between these pulses) corresponding to the rank values of each substrate which are used for printing the test patterns obtained in the step S6 of FIG. 5.

Further, in step S104, one of n times of printing controls is selected and the selected printing control is determined as correction reference OD value data. Actually, the reference OD value data is processed data which has been subjected to a smoothing process so as to have an average value of several nozzles (x direction) and several hundred dots (y direction) located before and behind a target nozzle with respect to the x direction and y direction shown in FIG. 6. A broken line shown in FIG. 8B indicates the correction reference OD value data. Note that the correction reference OD value data shown in FIG. 8B is created from printing patterns obtained by determining the rank value as "2".

In step S105, the correction reference OD value data thus obtained is compared with the change (actual data and predicted data) of the OD values on n (n=4) printing patterns obtained from the n combinations of driving control pulses which correspond to the four rank values, so that the rank value corresponding to an OD value whose amount of displacement from the correction reference OD value is minimum is selected. Each plot illustrated in FIG. 8B indicates a selected value.

FIG. 8B shows the change of the OD values for the nozzles 1 to 24. For instance, the rank 3 is selected for the nozzle 1, the rank 1 is selected for the nozzle 2 and the rank 2 is selected for the nozzle 24. The rank values selected respectively for the nozzles are shown in the lower part of FIG. 8B. These rank values constitute direct data for correcting the density unevenness of the printhead. In this manner, the combination of the driving control pulses which produces an OD value nearest to the correction reference OD value data corresponding to each nozzle, that is to say, one of the rank values is selected from n (here, n=4) ranks.

Such a selection is carried out for each of the nozzles.

A predicted OD value after the correction for each nozzle is determined by the above-described processes up to the step S105.

In step S106, on the basis of the determined value, the average value of the sum of squares of the density difference between adjacent nozzles is obtained for each nozzle. The value obtained in such a way represents a value when the correction reference OD value data determined by determining the rank value as "2" is employed as illustrated in FIG. 8B.

Now, the process returns to the steps S104 to S105 in order to verify whether or not the selected rank value thus obtained is optimum as the correction data and a predicted OD value is acquired in a case where another rank value is determined as correction reference OD value data. Then, with respect to this determined value the average value of the sum of squares of the density difference between adjacent nozzles is obtained for each nozzle.

The above-mentioned processes are repeated n times, namely, four times in this case, so that four kinds of predicted OD values are obtained. In the step S106, a predicted OD value having a minimum value is selected as optimized density unevenness correction data among the average values of the sums of squares of the density difference between adjacent nozzles for each nozzle with respect to the four kinds of predicted OD values thus acquired.

Then, in the step S106, when it is decided that such an optimization is completed, the process advances to step S107 and the obtained rank value is edited as correction data.

As described above, according to this embodiment, the number of tests can be reduced to one without repeating the processes of the steps S6 to S10 as compared with the conventional technique disclosed in Japanese Patent Application No. 6-34558. In other words, time required for generating the correction data can be decreased.

With the correction according to the present embodiment, since the correction is carried out on the basis of the actual printing operation of the printhead, a more accurate correction can be performed, compared to a method of performing a predicted correction on the basis of the unevenness data of manufacturing and inspection processes of the printhead.

Figure 10:
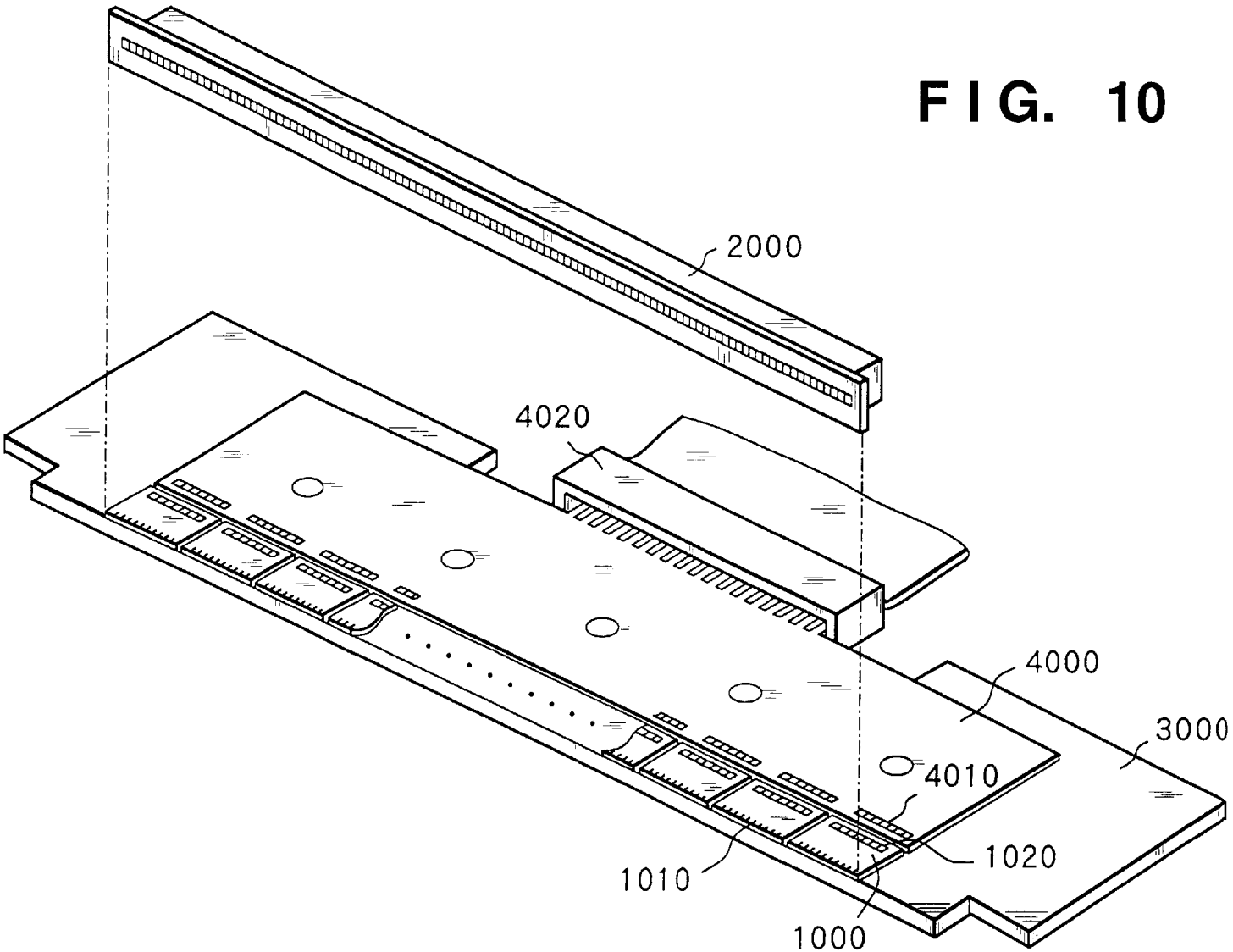
FIG. 10 is an exploded perspective view for describing the construction of a printhead according to the present invention.

FIG. 10 is an exploded perspective view for describing the construction of the printhead of this embodiment. In this example, a case is described in which the printing elements are elements for generating ink-discharge energy used to jet ink. (In a bubble-jet printing method, each element comprises a pair of electrodes and a heating resistor element provided between these electrodes).

In accordance with the method described below, the full-line printhead, which is faultlessly fabricated over its entire width by a conventional photolithographic process or the like, is obtained at a very high yield. Moreover, a single, unitary grooved member having a plurality of ink discharge orifices formed in one end and a plurality of grooves connected to these orifices and formed in the grooved member from one end to the other is joined to this printhead in such a manner that the grooves are closed by the boards, whereby a full-line, ink-jet printhead unit can be corrected in a very simple manner.

The ink-jet printhead described in this embodiment has ink discharge orifices at a density of 360 dpi (70.5 $\mu$m), the number of nozzles thereof being 3008 (for a printing width of 212 mm).

In FIG. 10, the board (hereinafter referred to as a heater board) 1000 has 128 discharge-energy generating devices 1010 arranged at prescribed positions at a density of 360 dpi. Each heater board 1000 is provided with a signal pad to drive the discharge-energy generating devices 1010 at any timing by externally applied electric signals, and with a power pad 1020 for supplying an electric power for the driving.

The row of the heater boards 1000 is fixedly bonded by a bonding agent to the surface of a base plate 3000 made of a material such as metal or ceramic.

Figure 11:
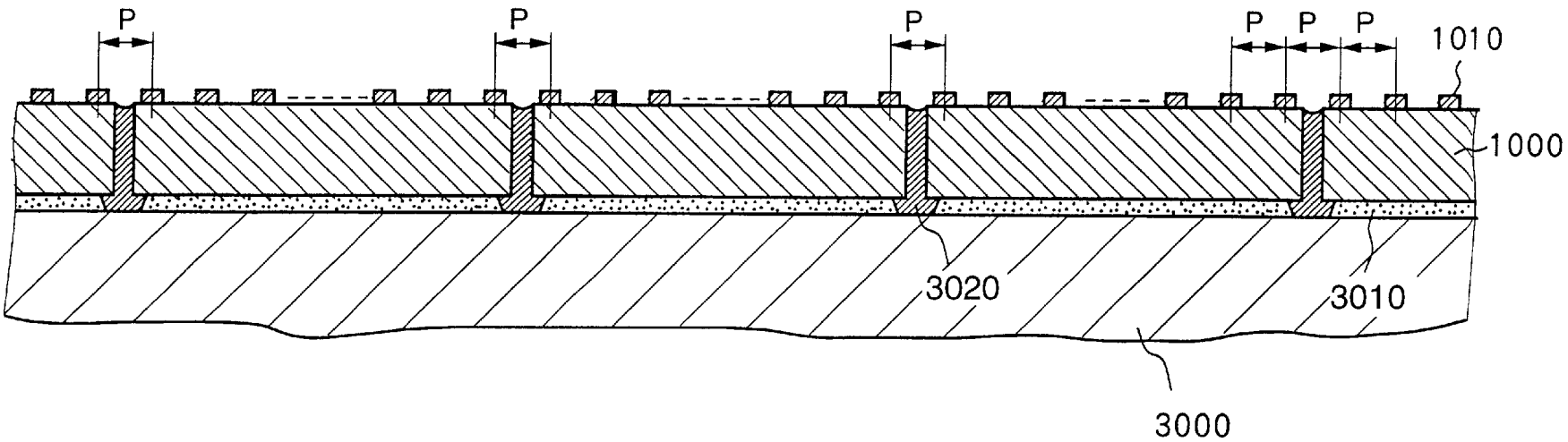
FIG. 11 is a detailed view showing heater boards arranged side by side.

FIG. 11 is a detailed view showing the heater boards 1000 in the arrayed state. The heater boards are fixedly bonded to a prescribed location on the base plate 3000 by a bonding agent 3010 applied to a prescribed thickness. At this time each heater board 1000 is fixedly bonded in precise fashion in such a manner that the spacing or pitch between the discharge-energy generating devices 1010 situated at the respective edges of two mutually adjacent heater boards will be equal to the spacing or pitch P (=70.5 $\mu$m) of the discharge-energy generating devices 1010 on each heater board 1000. Further, the gaps produced between adjacent heater boards 1000 are filled and sealed by a sealant 3020.

With reference again to FIG. 10, a wiring board 4000 is fixedly bonded to the base plate 3000 in the same manner as the heater boards. At this time the wiring board 4000 is bonded to the base plate 3000 in a state in which the pads 1020 on the heater boards 1000 are in close proximity to signal-power supply pads 4010 provided on the wiring board 4000. A connector 4020 for receiving a printing signal and driving power from the outside is provided on the wiring board 4000.

A grooved member 2000 will now be described.

Figure 12D:
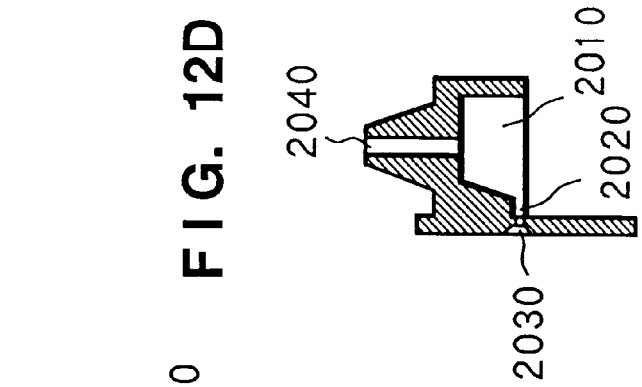
FIGS. 12A, 12B, 12C and 12D illustrate the shape of a grooved member.
Figure 12A:
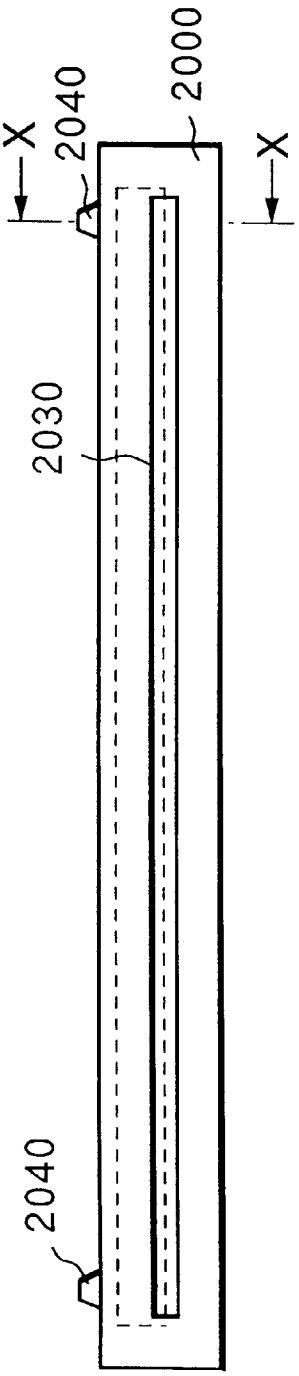
Figure 12B:
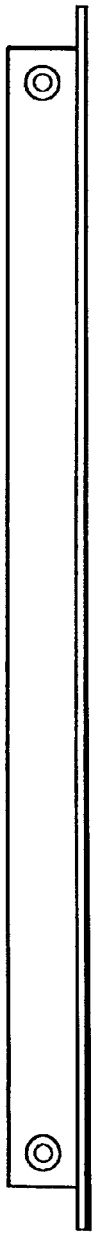
Figure 12C:
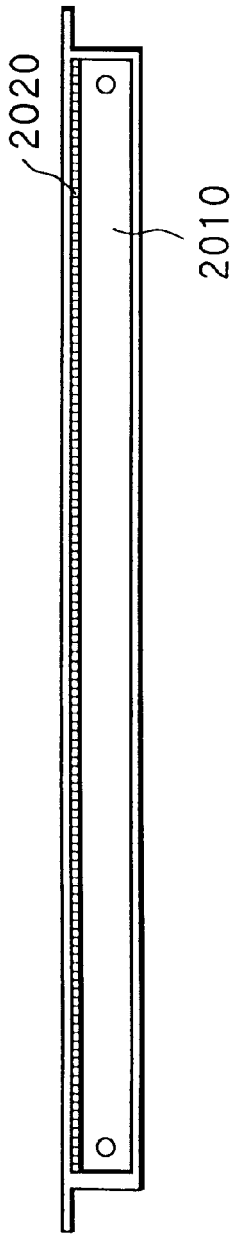

FIGS. 12A~12D are diagrams showing the shape of the grooved member 2000. FIG. 12A is a front view in which the grooved member 2000 is seen from the front, FIG. 12B a top view in which FIG. 12A is seen from the top, FIG. 12C a bottom view in which FIG. 12A is seen from the bottom, and FIG. 12D a sectional view taken along line X—X of FIG. 12A.

In FIGS. 12A~12D, the grooved member 2000 is shown to have a flow pass 2020 provided to correspond to each discharge-energy generating element 1010 provided in the heater board 1000, an orifice 2030 corresponding to each flow pass 2020 and communicating with the flow pass 2020 for discharging ink toward the recording medium, a liquid chamber 2010 communicating with each flow pass 2020 in order to supply it with ink, and an ink supply port 2040 for feeding ink, which has been supplied from an ink tank (not shown), to the liquid chamber 2010. The grooved member 2000 naturally is formed to have a length large enough to substantially cover the row of discharge-energy generating devices arranged by lining up a plurality of the heater boards 1000.

With reference again to FIG. 10, the grooved member 2000 is joined to the heater boards 1000 in a state in which the positions of the flow passage 2020 of the grooved member 2000 are made to exactly coincide with the positions of the discharge-energy generating elements (heaters) 1010 on the heater boards 1000 arranged in a row on the base plate 3000.

Conceivable methods of joining the grooved member 2000 are a method in which the grooved member is pushed in mechanically using springs or the like, a method in which the grooved member 2000 is fixed by a bonding agent, and a method which is a combination of these methods.

Figure 13:
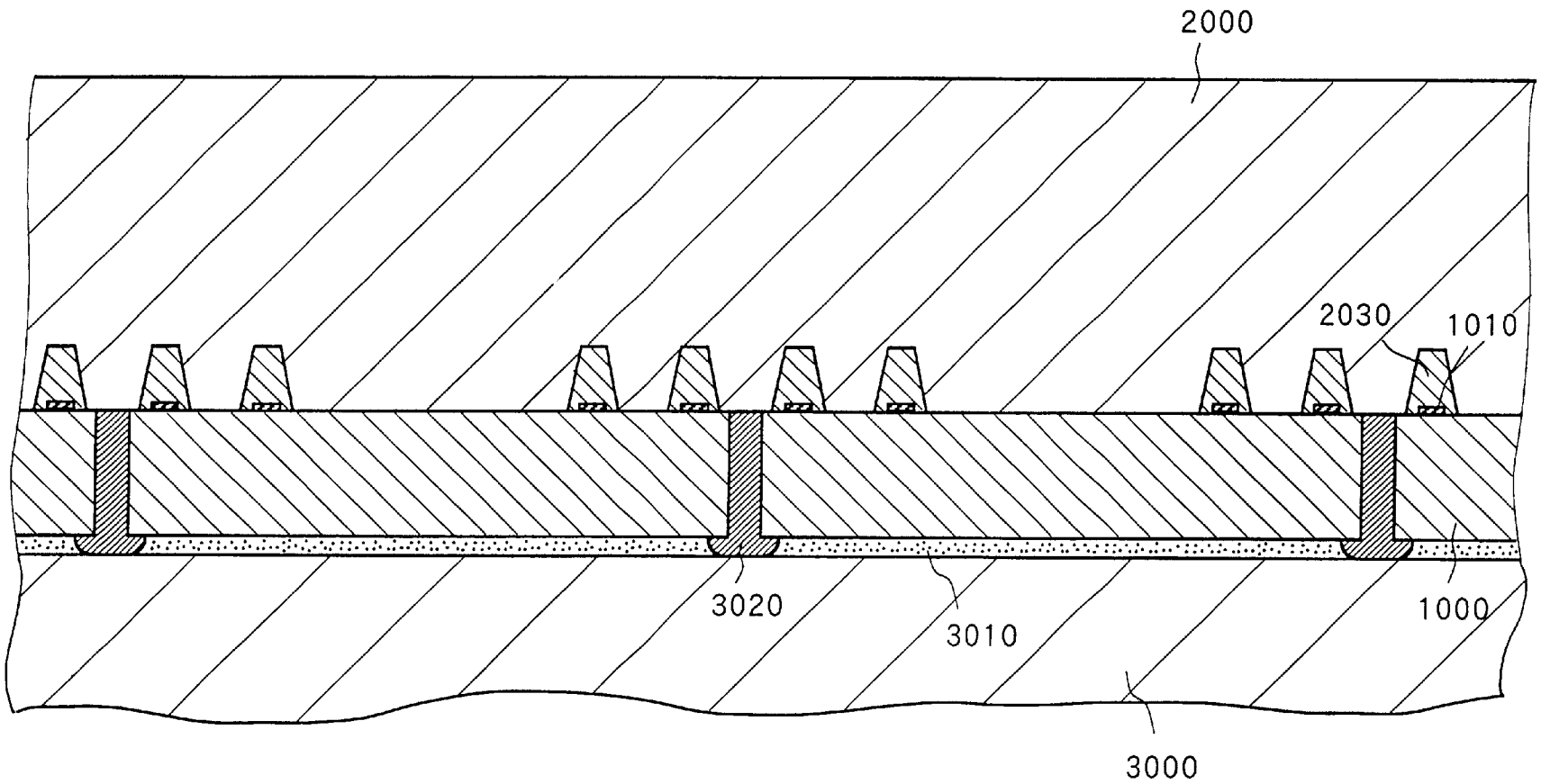
FIG. 13 is a diagram showing the grooved member and heater boards in a fixed state.

The grooved member 2000 and each of the heater boards 1000 are secured in the relationship shown in FIG. 13 by any of these methods.

The grooved member 2000 described above can be manufactured using well-known methods such as machining by cutting, a molding method, casting or a method relying upon photolithography.

FIG. 14 shows an example of drive circuitry provided on the heater board 1000 of the printhead. Numeral 100 denotes a base, 101 a logic block for selecting preheating pulses, 303 a latch for temporarily storing image data, 102 a selection-data saving latch, having the same circuit arrangement as the latch 303, for selecting preheating pulses, and 103 an OR gate for taking the OR of heating pulses and preheating pulses.

The operation of this drive circuitry will now be described in line with a driving sequence.

After power is introduced from a logic power source 309, preheating pulses are selected dependence upon the characteristic of the amount of ink discharged (per application of a pulse at a fixed temperature). The characteristic is measured in advance. Data of each nozzle (the data is identical for one nozzle or four nozzles) for selecting the preheating pulses in dependence upon the aforesaid characteristic is saved in the selection-data saving latch 102 using a shift register 304 for entering image data serially. Since shared use is made of the shift register 304 for entering image data, it will suffice merely to increase the number of latch circuits and latch the outputs of the shift register 304 as input signals in parallel fashion, as shown at points a in FIG. 14. This makes it possible to prevent an increase in the surface area of the elements other than that of the latch circuits. Further, in a case where the number of preheating pulses is increased and the number of bits necessary for selection of the number of pulses surpasses the number of bits of the shift register 304, this can readily be dealt with if the latch 102 is made plural in number and a latch-clock input terminal 108 which decides latching is made plural in number, as shown at 108*a*~108*h*.

As stated above, it goes without saying that, if correction is made in units of eight (8) nozzles or sixteen (16) nozzles, the device configuration of the printhead can be simplified by reducing a number of latch circuits.

It will suffice if the saving of data for selection of the preheating pulses is performed one time, such as when the printer is started up. The image-data transfer sequence will be performed exactly the same as conventionally even if this function is incorporated. Furthermore, an arrangement may be adopted in which the number of bits in logic block 101 and in the selection-data saving latch 102 is made one-fourth, the preheating pulses are selected in units of four nozzles and are supplied in units of four nozzles.

Entry of heating signals will now be described as a sequence which follows completion of the storing of saved data, representing the amount of ink discharge, for selection of preheating pulses.

A characterizing feature of this board is that a heating input terminal 106 and a plurality of preheating input terminals 107*a*~107*h*, which are used for changing the amount of ink discharged, are separately provided. First, a signal from the heating-resistor monitor 314 is fed back and a heating signal having a pulse width of an energy suited to discharge of ink in dependence upon the value of feedback is applied to the heating input terminal 106 from the side of the printing apparatus. Next, the pulse width and timing of each of the plurality of preheating signals are changed in dependence upon the value from the temperature sensor 315 and, at the same time, preheating signals are applied from the plurality of preheating pulse terminals 107*a*~107*h* in such a manner that the amount of ink discharged will vary under fixed temperature conditions.

Thus, if a selection is made to deal with a factor other than temperature, namely a change in the amount of ink discharge of each nozzle, the amount of ink discharge can be rendered constant to eliminate unevenness and blurring. One of the plurality of preheating pulses thus entered is selected in dependence upon selection data saved in advance in the preheat selection logic block (latch) 102. Next, an AND signal between the image data and heating signal is OR-ed with a selected preheating pulse by the OR gate 103, and the resulting signal drives a power transistor 302, thereby passing an electric current through the heater 1010 to discharge ink.

Shown in FIG. 14 are an input signal input terminal 104, a clock input terminal 105, a latch signal input terminal 307, a ground terminal 310, a power-supply voltage input terminal 311 for heating purposes, an output terminal 312 for heating-resistor monitoring data, and an output terminal 313 for data indicating the temperature inside the printhead.

Figure 15:
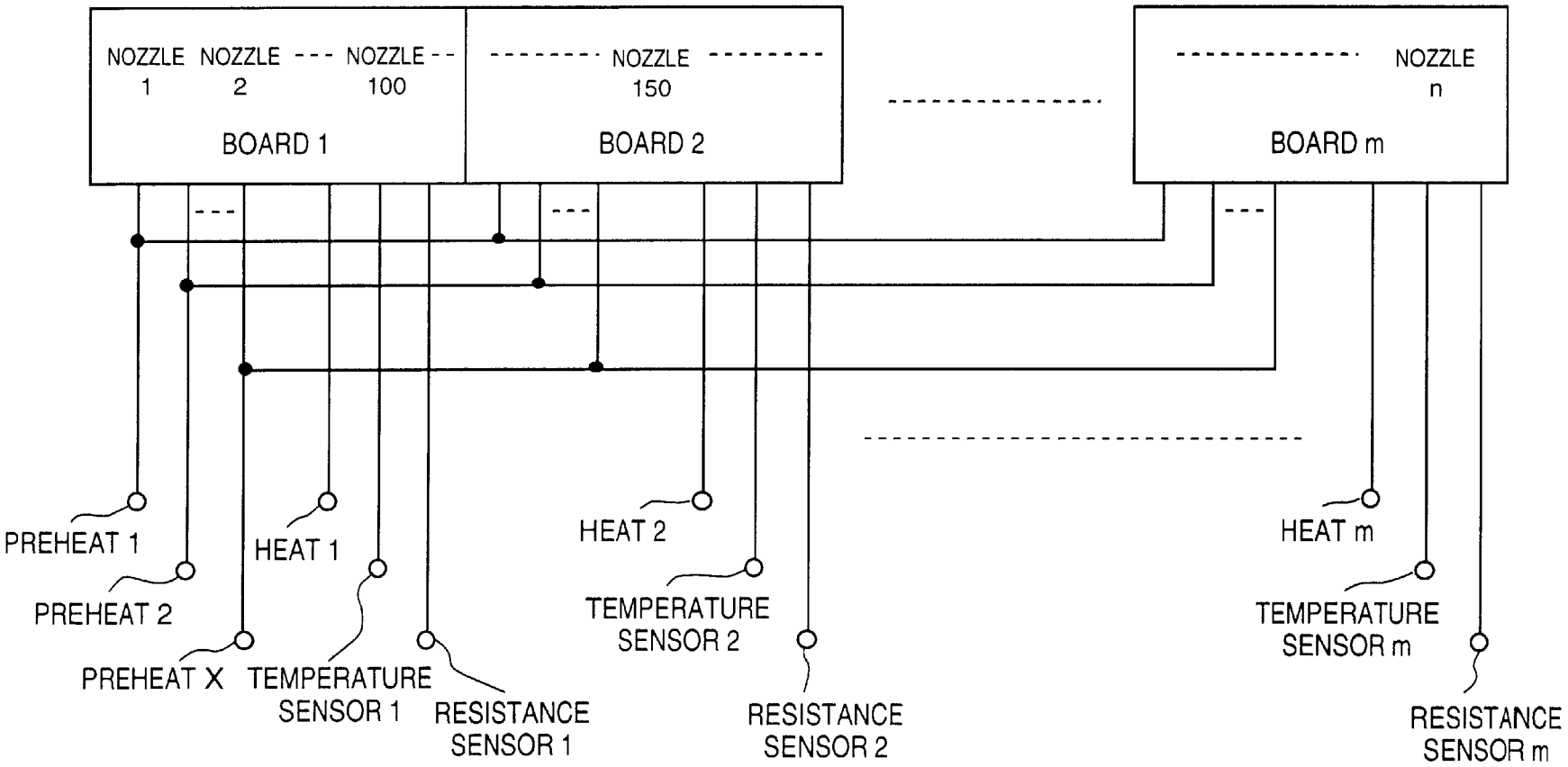
FIG. 15 is a block diagram showing a multiple-nozzle head constituted by an array of a plurality of heater boards.

Reference will be had to FIG. 15 to describe the construction of a multiple-nozzle head constituted by a plurality of the heater boards 1000 arranged in a row. There are m-number of boards in the row and a total of n-number of nozzles. The description will focus on nozzles 1, 100 of board 1 and nozzle 150 of board 2.

Figure 16:
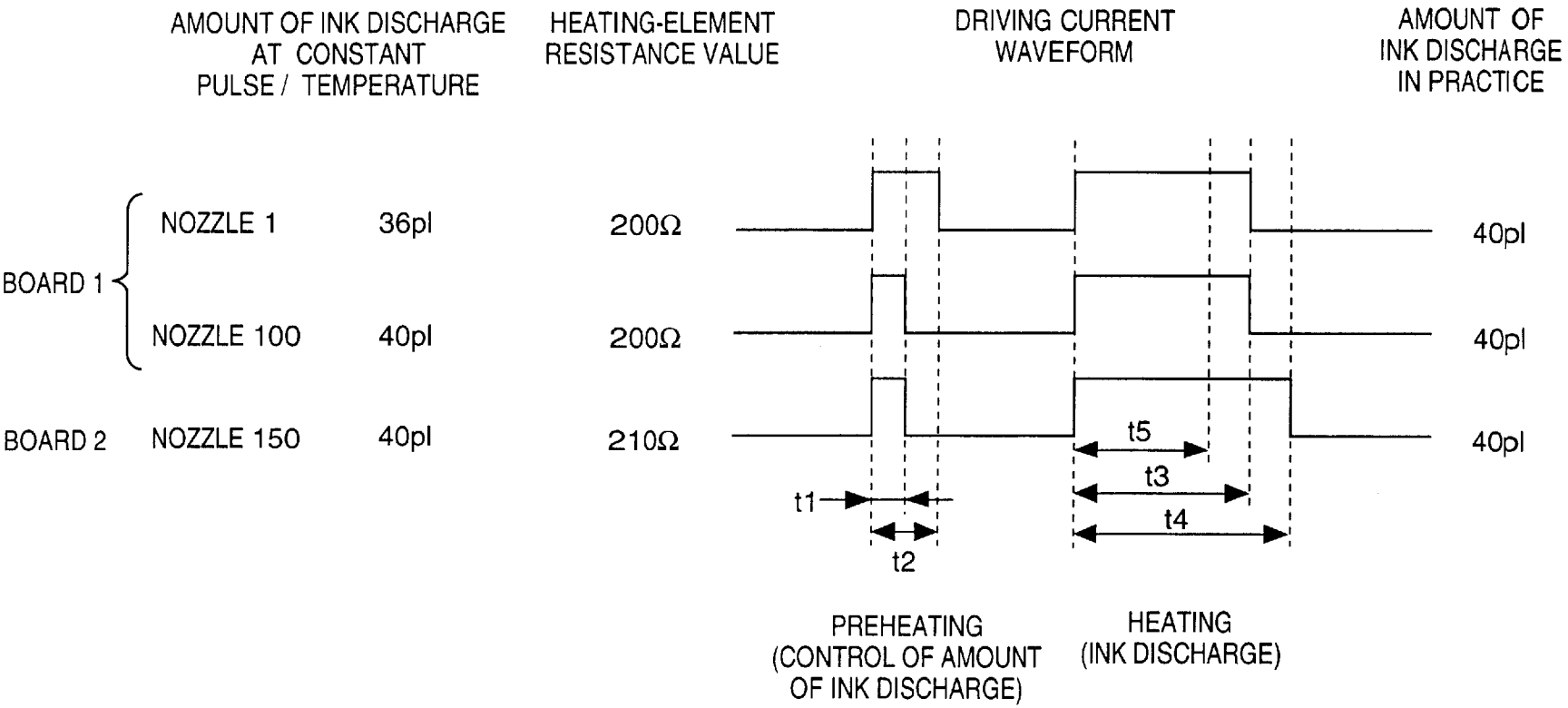
FIG. 16 is a diagram showing an example of control of driving current waveforms for driving the printing elements.

As shown in FIG. 16, assume that the amounts of ink discharged by nozzles 1, 100 and 150 are 36 pl, 40 pl and 40 pl, respectively, at application of a constant pulse width at a constant temperature. In such case, selection data having a level such that the amount of ink discharged will be greater for nozzle 1 than for nozzles 100, 150 is set in the selection-data saving latch. Since it is known from resistance sensors 1, 2 that 200 Ω is the heating-resistance value of board 1 and that 210 Ω is the heating-resistance value of board 2, as shown in FIG. 16, the pulse width applied to board 2 is made larger than that applied to board 1 so that the introduced power will be rendered uniform. FIG. 16 illustrates driving current waveforms applied under these conditions. It will be understood that the preheating pulse of nozzle 1 which discharges a small amount of ink has a pulse width larger than that of the preheating pulses for nozzles 100 and 150 ($t1<t2$). Further, the heating pulse width t4 is larger than t3 ($t4>t3$). In FIG. 16, t5 represents the pulse width for minimum power needed to foam the ink and cause the ink droplets to be discharged from the nozzles. The following relationships hold: $t1, t2<t5$ and $t3, t4>t5$.

Thus, the preheating pulses are changed under conditions in which the relations $t1<t2$; $t1, t2<t5$ hold with respect to a change in the temperature of the board during drive. As a result, the amount of ink discharged from each nozzle during actual drive can be made 40 pl at all times. This makes it possible to achieve high-quality printing without unevenness and blurring. Furthermore, with regard to the heating pulses exhibiting a high power, the pulse width is adjusted in dependence upon the resistance value of the board, whereby a constant power is applied without waste. This contributes to a longer service life for the printhead.

Furthermore, if emphasis is placed upon a change in the quiescent interval and a printed dot which cannot be corrected within the range of this change is corrected utilizing the preheating pulses as well, then a large change in energy need not be applied to the printing elements of the printhead, the life of the printhead can be extended and the quality of a printing image can be improved.

Figure 17:
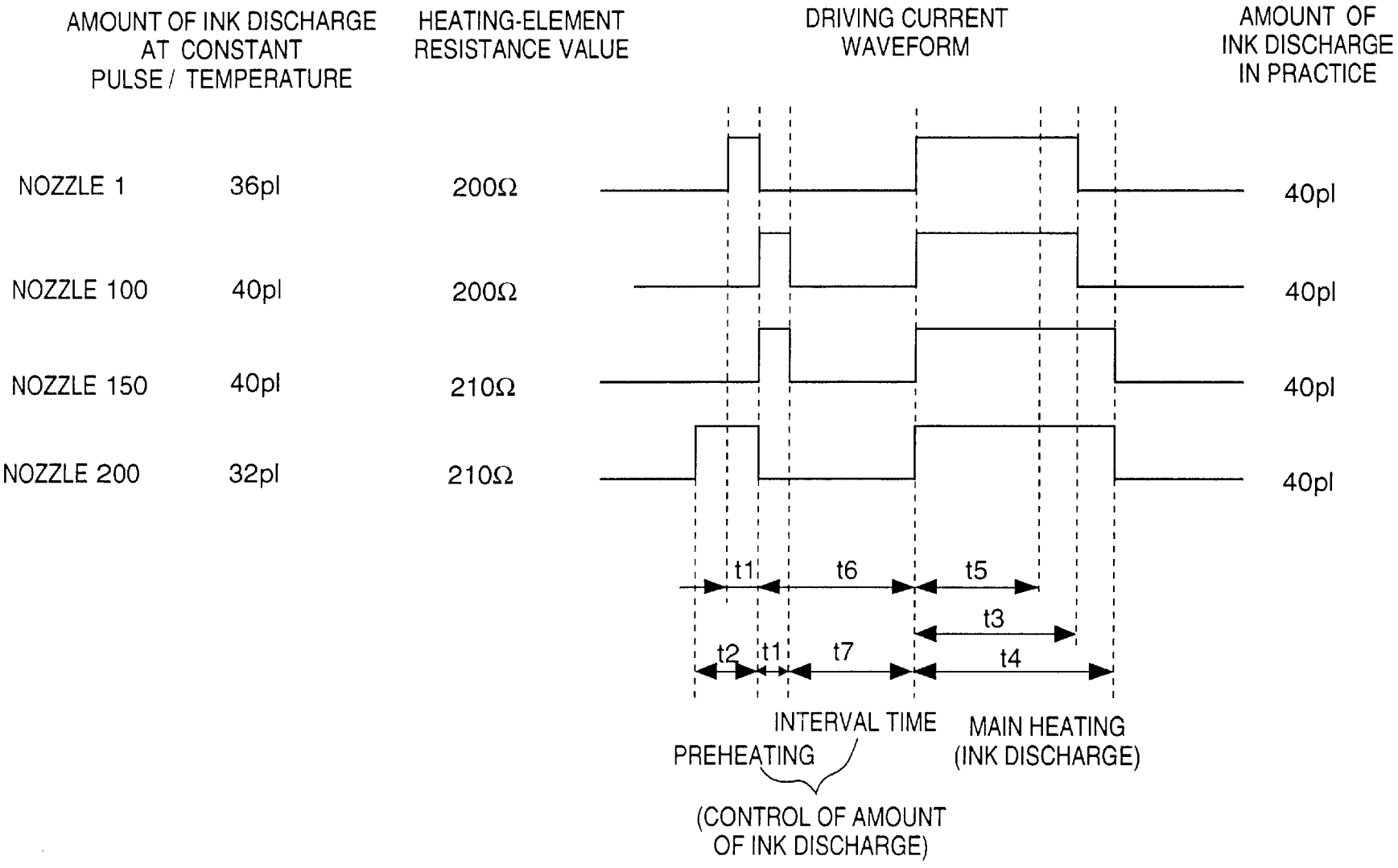
FIG. 17 is a diagram showing driving current waveforms for driving the printing elements.

In this embodiment, the application of drive pulses differs from that shown in FIG. 17 with regard particularly to nozzle 1 and nozzle 200, as shown in FIG. 16. With regard to nozzle 1, density is somewhat lower in comparison with nozzles 100 and 150 (the amount of reduction in ink discharge is 10%). Therefore, the quiescent interval is made slightly longer (t6) in comparison with that (t7) for nozzles 100 and 150. On the other hand, with regard to nozzle 200, there is a very large difference in density in comparison with nozzles 100 and 150 (the amount of reduction in ink discharge is 20%). Therefore, while the interval time is lengthened (t6), the preheating pulse width is stretched (t2) in comparison with the heating pulse width (t1) of nozzles 1, 100 and 150 to correct the amount in ink discharge. If this arrangement is adopted, a correction of density unevenness can be achieved without applying a large change in energy to the printing elements of the printhead.

Thus, in accordance with the present invention, the dots of prescribed pattern data, which have been printed by a printhead, are gathered together in a prescribed plurality of areas per each nozzle (recording element) of the printhead upon taking into account the visual discriminating ability of the human eye, and information obtained from the plurality of areas can be applied as density unevenness data. As a result, a variation in dot-to-dot diameter which exceeds the visual discriminating ability of the human eye is no longer discerned as density unevenness. In comparison with a case in which the dot diameter of each dot is discerned as density unevenness, information capable of accurate density correction can be supplied more rapidly for each printing element. As a result, it is possible to perform more rapid entry of fine correction data adapted to each printing element in the final stage of the printhead manufacturing process.

Furthermore, in a case where the amount of ink per printing operation discharged from each nozzle of the printhead is adjusted using the correction data obtained, the width of the quiescent interval between a preheating pulse and a main heating pulse is adjusted along with the pulse widths of these pulses. As a result, even if the amount of ink discharge fluctuates widely between nozzles under conditions of a constant pulse width or constant temperature, control can be performed so as to equalize the amount of ink discharge from one nozzle to the next without lengthening pulse width to such an extent that the printhead will be subjected to an abnormally large load. This makes it possible to prolong the life of the printhead while attaining a high image quality.

Furthermore, since a rank value is selected for correcting density for each nozzle (printing element) so as to have an OD value equal or close to the OD value on the basis of the reference density distribution obtained by taking the characteristic of each unit of the printhead into consideration and a control is performed so that a proper preheat pulse is applied or a suitable pulse interval is obtained, a more accurate density correction can be performed by considering the characteristic of the printhead. In the present embodiment, since the verifying processes of selected correction parameters can be optimized, an effective correction can be done without performing experimental printing operations a plurality of times.

In the description set forth above, it is mentioned that the selection of preheating pulses interval time suitable to each board is controlled. However, this does not impose a limitation upon the invention. For example, the density correction may be performed by changing the width of the main heating pulses using a counter or the like.

Furthermore, it goes without saying that the present invention may be applied to effect a density correction if the board is such that control of the driving power of each printing element is possible. The same density correction can be performed even if the printhead has a construction different from that described.

In the description given above, it is described that the control unit on the side of the printing apparatus controls the printing operation of the printhead on the basis of correction data that has been stored in a memory within the printhead. However, an arrangement may be adopted in which such a control unit is provided within the printhead.

Though a full-line printer has been taken as an example in the description given above, the invention is not limited to such a printer. For example, in a serial printer of the type in which printing is performed by moving a printhead mounted on a carriage, the invention is applicable to an arrangement in which the printing is carried out by a number of nozzles arrayed in a row in the direction in which the recording paper is conveyed. Also, this invention is applicable to another type of printhead such as an ink jet printhead, thermal printhead or LED printhead.

It goes without saying that equivalent effects are obtained even if there is a difference in the method of setting the driving power of each of the recording elements of the printhead.

Each of the embodiments described above has exemplified a printer, which comprises means (e.g., an electrothermal transducer, laser beam generator, and the like) for generating heat energy as energy utilized upon execution of ink discharge, and causing a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead, which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as lack or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, it goes without saying that the invention is applicable also to a case where the object of the invention is attained by supplying a program to a system or apparatus.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for correcting a printing characteristic of a printhead having a plurality of printing elements and memory means for storing data, comprising:

printing control means for using said printhead, using n kinds of printing control signal patterns and experimentally printing a printing pattern made of pixels in response to the printing control signal patterns on a printing medium;

reference density generating means for generating a reference density distribution on the basis of one of n kinds of the printing patterns printed on the printing medium;

selecting means for selecting one of the n kinds of printing control signal patterns for each of the printing elements such that a density value on each pixel is equal or close to the reference density distribution;

optimizing means for controlling said reference density generating means so as to generate a reference density distribution different from the initially generated reference density distribution on the basis of another one of the n kinds of the printing patterns printed, controlling a selection by said selecting means on the reference density distribution different from the initially generated reference density distribution created and selecting an optimum one of the n kinds of printing control signal patterns; and transmitting means for determining an optimum printing control signal selected by said optimizing means as correction data and transmitting the correction data to said memory means of said printhead.

2. The apparatus according to claim 1, further comprising:

characteristic obtaining means for obtaining an electrical characteristic of said printhead in units of a predetermined number of printing elements; and calculating means for, on the basis of the electrical characteristic, calculating a pulse characteristic to be applied to said printhead so as to carry out a printing operation in units of the predetermined number of printing elements.

3. The apparatus according to claim 2, wherein the electrical characteristic obtained by said characteristic obtaining means is a resistance characteristic.

4. The apparatus according to claim 1, wherein said optimizing means selects, as an optimum printing control signal pattern, a printing control signal pattern having a minimum value among average values of sums of squares of differences, between a density of each printing element and a density of another printing element adjacent to the printing element, which are obtained in respect with each of the n kinds of printing control signal patterns.

5. The apparatus according to claim 1, wherein said printing control means further comprises computing means for obtaining more than the n kinds of printing control signal patterns on the basis of the density distributions generated based on the n kinds of the printing patterns printed.

6. The apparatus according to claim 5, wherein the more than the n kinds of printing control signal patterns are obtained by applying a linear approximation to the density distributions based on the n kinds of the printing patterns printed.

7. The apparatus according to claim 1, wherein said printing control means changes a preheat pulse width and pulse interval width in a double pulse width control little by little n times, and the printing pattern is printed n times with preheat pulse width and pulse interval width newly obtained as a result of the change.

8. The apparatus according to claim 1, wherein said reference density generating means smoothes the density of the printing patterns in units of predetermined pixels in the arrangement direction of the printing elements and in the conveyance direction of the printing medium so as to generate the reference density distribution.

9. A printhead corrected by the apparatus according to claim 1.

10. The printhead according to claim 9, further comprising:

input means for externally inputting printing data; and driving means for driving the plurality of printing elements on the basis of the printing data inputted by said input means.

11. The printhead according to claim 9, wherein said memory means includes an EEPROM.

12. The printhead according to claim 9, wherein the number of the plurality of printing elements is N, and (N/M) circuit substrates, each having M printing elements, are arranged in a line.

13. The printhead according to claim 9, wherein said printhead is an inkjet printhead which discharges ink so as to perform a printing operation.

14. The printhead according to claim 13, wherein said inkjet printhead is provided with an electrothermal transducer for generating thermal energy applied to ink in order to discharge the ink by using the thermal energy.

15. A printing apparatus using the printhead according to claim 9, comprising:

receiving means for receiving the correction data from said printhead;

control means for generating a control signal for controlling the operation of said driving means so as to form uniform pixels over the plurality of printing elements on the basis of said correction data; and transmitting means for transmitting the control signal to said printhead.

16. The apparatus according to claim 15, wherein said printhead is an inkjet printhead which discharges ink to perform a printing operation.

17. The apparatus according to claim 16, wherein said inkjet printhead is provided with an electrothermal transducer for generating thermal energy applied to ink in order to discharge the ink by using the thermal energy.

18. A method of correcting a printing characteristic of a printhead having a plurality of printing elements and a memory unit for storing data, said method comprising:

a printing control step for using said printhead, using n kinds of printing control signal patterns and experimentally printing a printing pattern made of pixels in response to the printing control signal patterns on a printing medium;

a reference density generating step for generating a reference density distribution on the basis of one of n kinds of the printing patterns printed on the printing medium;

a selecting step for selecting one of the n kinds of printing control signal patterns for each of the printing elements such that a density value on each pixel is equal or close to the reference density distribution;

an optimizing step for controlling said reference density generating step so as to generate a reference density distribution different from the initially generated reference density distribution on the basis of another one of the n kinds of the printing patterns printed, controlling a selection at said selecting step on the reference density distribution different from the initially generated reference density distribution and selecting an optimum one of the n kinds of printing control signal patterns; and a transmitting step for determining an optimum printing control signal selected at said optimizing step as correction data and transmitting the correction data to the memory unit of said printhead.

* * * * *

UNITED STATES PATENT AND TRADEMARK OFFICE

CERTIFICATE OF CORRECTION

PATENT NO. : 6,325,482 B1
DATED : December 4, 2001
INVENTOR(S) : Hayasaki et al.

It is certified that error appears in the above-identified patent and that said Letters Patent is hereby corrected as shown below:

Column 2,
Line 38, "then" should read -- the --.
Line 49, "a room" should read -- room --.
Line 61, "small, however," should read -- small. However, --.

Column 4,
Line 19, "of, the" should read -- of the --.

Column 9,
Line 21, "atthreshold" should read -- threshold --, and "the" should read -- a --.
Line 22, "a case" should read -- the case --.
Line 35, "averaged" should read -- averaged. --.
Line 36, "processing)." should read -- processing.) --.

Column 13,
Line 7, "electrodes)." should read -- electrodes.) --.
Line 64, "pass" should read -- passage --.
Line 67, "pass" (both occurrences) should read -- passage --.

Column 14,
Line 2, "pass" should read -- passage --.
Line 40, "dependence" should read -- dependent --.

Column 18,
Line 55, "lack" should read -- black --.

Signed and Sealed this

Seventh Day of May, 2002

*Attest:*

*Attesting Officer*

JAMES E. ROGAN
*Director of the United States Patent and Trademark Office*